US010386754B2

(12) United States Patent
Takenaga et al.

(10) Patent No.: US 10,386,754 B2
(45) Date of Patent: Aug. 20, 2019

(54) BELT DEVICE AND IMAGE FORMING APPARATUS INCORPORATING SAME

(71) Applicant: RICOH COMPANY, LTD., Tokyo (JP)

(72) Inventors: Noriaki Takenaga, Tokyo (JP); Kazuhiro Shimojima, Kanagawa (JP); Masami Takeshita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 18 days.

(21) Appl. No.: 15/424,191

(22) Filed: Feb. 3, 2017

(65) Prior Publication Data

US 2017/0242370 A1 Aug. 24, 2017

(30) Foreign Application Priority Data

Feb. 19, 2016 (JP) ..... 2016-030310
Mar. 11, 2016 (JP) ..... 2016-048539
May 9, 2016 (JP) ..... 2016-094068

(51) Int. Cl.
*G03G 15/16* (2006.01)
*G03G 21/00* (2006.01)
*G03G 15/00* (2006.01)

(52) U.S. Cl.
CPC ..... *G03G 15/161* (2013.01); *G03G 15/5054* (2013.01); *G03G 2215/1661* (2013.01)

(58) Field of Classification Search
None
See application file for complete search history.

(56) References Cited

U.S. PATENT DOCUMENTS 6,842,602 B2 * 1/2005 Kudo ..... G03G 15/757 347/116
7,133,630 B2 * 11/2006 Sakai ..... G03G 15/0131 399/301
7,532,370 B2 * 5/2009 Kudo ..... H04N 1/0473 358/474
8,111,409 B2 * 2/2012 Tabata ..... B41J 19/205 358/1.12
8,190,051 B2 * 5/2012 Sano ..... G03G 15/161 399/101
8,306,469 B2 * 11/2012 Kimura ..... G03G 15/161 399/123
8,548,350 B2 * 10/2013 Hozumi ..... G03G 15/161 399/101

(Continued)

FOREIGN PATENT DOCUMENTS

JP 10147447 A * 6/1998
JP 2004271718 A * 9/2004

(Continued)

*Primary Examiner* — Clayton E. LaBalle
*Assistant Examiner* — Leon W Rhodes, Jr.
(74) *Attorney, Agent, or Firm* — Xsensus LLP

(57) ABSTRACT

A belt device includes a movable belt, a detection target, an optical detector, and a cleaner. The belt is looped around a plurality of supporting members. The detection target is disposed extending along a direction of belt movement on at least one side of the belt in a width direction of the belt intersecting with the don of belt movement. The optical detector detects the detection target. The cleaner is attached to at least one of the plurality of supporting members to clean the detection target.

20 Claims, 25 Drawing Sheets

(56) References Cited

U.S. PATENT DOCUMENTS

| | | | |
|---|---|---|---|
| 2008/0101818 | A1 | 5/2008 | Shimojima et al. |
| 2011/0211875 | A1 | 9/2011 | Takeshita et al. |
| 2012/0051804 | A1 | 3/2012 | Takeshita et al. |
| 2014/0126926 | A1 | 5/2014 | Takenaga |
| 2015/0253699 | A1 | 9/2015 | Shimojima et al. |
| 2015/0293487 | A1 | 10/2015 | Takenaga et al. |

FOREIGN PATENT DOCUMENTS

| | | | | |
|---|---|---|---|---|
| JP | 2004341219 | A | * | 12/2004 |
| JP | 2005-092126 | | | 4/2005 |
| JP | 2013-156299 | | | 8/2013 |
| JP | 2016-012087 | | | 1/2016 |

* cited by examiner

BELT DEVICE AND IMAGE FORMING APPARATUS INCORPORATING SAME

CROSS-REFERENCE TO RELATED APPLICATIONS

This patent application is based on and claims priority pursuant to 35 U.S.C. § 119 to Japanese Patent Application Nos. 2016-030310, filed on Feb. 19, 2016, 2016-048539, filed on Mar. 11, 2016, and 2016-094068, filed on May 9, 2016 in the Japan Patent Office, the entire disclosure of which is hereby incorporated by reference herein.

BACKGROUND

Technical Field

Exemplary aspects of the present disclosure relate to a belt device and an image forming apparatus incorporating the belt device.

Related Art

Image forming apparatuses include a belt device such as a transfer unit as a transfer member and a conveyance unit as a conveyance member. The belt device includes an endless belt member looped around a plurality of supporting members such as rollers. Such a belt device may include a tape-shaped detection target read by an optical detector to control a movement speed (a conveyance speed) of the belt member. The detection target is attached on at least one side of the belt member in a belt width direction perpendicular to a belt movement direction and across a longitudinal direction (a length direction) of the belt member. The tape-shaped detection target is also called a scale tape, and has slits or asperities. The optical detector detects such slits or asperities.

SUMMARY

In at least one embodiment of this disclosure, there is provided an improved belt device that includes a movable belt, a detection target, an optical detector, and a cleaner. The belt is looped around a plurality of supporting members. The detection target is disposed extending along a direction of belt movement on at least one side of the belt in a width direction of the belt intersecting with the direction of belt movement. The optical detector detects the detection target. The cleaner is attached to at least one of the plurality of supporting members to clean the detection target.

Further provided is an improved image forming apparatus including the belt device described above and a transfer unit. The transfer unit transfers an image on the belt to a recording medium. In the image forming apparatus, the cleaner is disposed downstream of the transfer unit in the direction of belt movement and an upstream side of the optical detector in the direction of belt movement.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
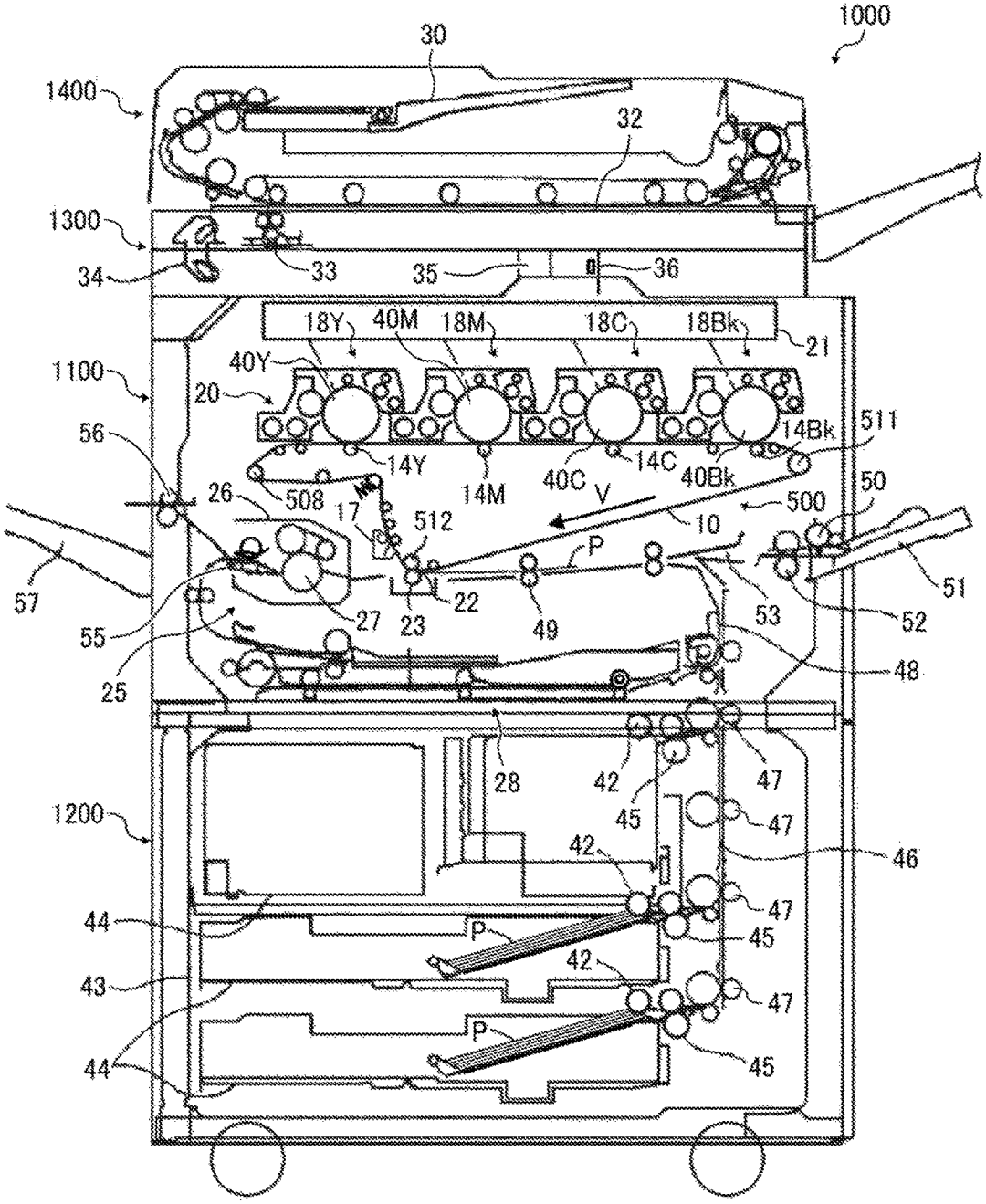
FIG. 1 is a schematic diagram illustrating an image forming apparatus including a belt device according to an exemplary embodiment.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

In the drawings, a configuration of the component or element may be partially omitted to describe one portion of the configuration. A belt device of an exemplary embodiment includes a movable belt, a detection target, an optical detector, and a cleaner. The belt is looped around a plurality of supporting members. The detection target is disposed across a longitudinal direction of the belt on at least one side of the belt in a width direction of the belt intersecting with a direction of belt movement. The optical detector detects the detection target. The cleaner is attached to at least one of the plurality of supporting members to clean the detection target. Accordingly, at least one of the supporting members supporting the belt moving in the direction of belt movement, the cleaner cleaning the detection target disposed in an end portion of the belt in a belt width direction, and the detection target area are arranged via a common supporting member. Such arrangement can enhance positional accuracy of the cleaner with respect to the detection target.

First, a description is given of a configuration of an image forming apparatus to which a belt device of each of the exemplary embodiments is applied. Then, a configuration of the belt device is described.

FIG. 1 illustrates an electrophotographic color copier 1000 as an image forming apparatus according to the exemplary embodiment. The color copier 1000 includes a copier body 1100 as an apparatus body of the image forming apparatus, a sheet feed table 1200 on which the copier body 1100 is placed, a scanner 1300 as an image reader attached on the copier body 1100, and an automatic document feeder (ADF) 1400 attached on the scanner 1300. The copier body 1100 includes a transfer unit 500 as a belt device including a transfer belt 10 as an intermediate transfer member of an endless belt member. The transfer unit 500 is disposed in a center portion of the copier body 1100. The transfer belt 10 is looped around a plurality of rollers as supporting members, and can move in a clockwise direction indicated by an arrow V (hereinafter referred to as "a belt movement direction V") illustrated in FIG. 1. A transfer cleaner 17 is disposed near the transfer belt 10 to remove residual toner remaining on the transfer belt 10 subsequent to transfer of an image. Moreover, in FIG. 1, four process cartridges 18Bk, 18C, 18M, and 18Y for black, cyan, magenta, and yellow are aligned above the transfer unit 500 and along the belt movement direction V from a downstream side. The process cartridges 18Bk, 18C, 18M, and 18Y form a tandem image forming unit 20, and an exposure device 21 is disposed above the tandem image forming unit 20. The process cartridges 18Bk, 18C, 18M, and 18Y respectively include drum-shaped photoconductors 40Bk, 40C, 40M, and 40Y as image bearers. The process cartridges 18Bk, 18C, 18M, and 18Y form toner images on the respective photoconductors 40Bk, 40C, 40M, and 40Y with toner as developer of respective colors by using a known electrophotographic functional member. The process cartridges 18Bk, 18C, 18M, and 18Y also have functions of cleaning surfaces of the respective photoconductors 40Bk, 40C, 40M, and 40Y subsequent to transfer of the toner images. Each of the process cartridges 18Bk, 18C, 18M, and 18Y and the transfer unit 500 is detachably supported by the copier body 1100.

A secondary transfer roller 23 as a secondary transfer rotator is disposed at a side opposite the tandem image forming unit 20 with the transfer belt 10 therebetween. The secondary transfer roller 23 is a supporting member for supporting the transfer belt 10 from outer side, and is pressed against a secondary transfer counter roller 512 as a secondary transfer counter rotator via the transfer belt 10 to form a secondary transfer portion (a nip portion) 22 as a transfer portion in a contact area between the transfer roller 23 and the secondary transfer counter roller 512. In the secondary transfer portion 22 transfer bias is applied to the secondary transfer counter roller 512 or the secondary transfer roller 23. Such application of the transfer bias transfers a toner image or a combined color image on the transfer belt 10 to a sheet P as a recording medium.

A fixing device 25 for fixing the toner image transferred to the sheet P is disposed downstream of the secondary transfer roller 23 in a sheet conveyance direction. The fixing device 25 includes a pressure roller 27 and a fixing belt 26 that is a belt member. The fixing device 25 presses the pressure roller 27 as a pressing rotator against the fixing belt 26 as a fixing rotator. In addition to the secondary transfer counter roller 512, an endless belt looped around a plurality of rollers may be used as the secondary transfer counter rotator. In the exemplary embodiment, a contact method by which the secondary transfer roller 23 as a secondary transfer member contacts the transfer belt 10 is employed. However, a non-contact charger may be disposed as the secondary transfer member. In such a case, since the roller member or the belt member has a difficulty in having a sheet conveyance function, a conveyance unit can be disposed separately.

In FIG. 1, a sheet reverse unit 28 for reversing a sheet P when images are recorded on two sides of the sheet P is disposed below the secondary transfer portion 22 and the fixing device 25 and parallel to the tandem image forming unit 20, so that duplex printing can be performed. In a case where the color copier 1000 performs only single-sided printing, the sheet reverse unit 28 may not necessarily be disposed. The color copier 1000 can be connected to an external terminal device such as a personal computer in a wired or wireless manner to function as a printer. The image forming apparatus is not limited to a color copier and a printer. The image forming apparatus can be a facsimile, or a multifunctional peripheral having two or more copying, printing, and facsimile functions.

When a user uses such a configuration of the color copier 1000 to make a color copy, the user sets a color document on a document tray 30 of the ADF 1400. Alternatively, the user can open the ADF 1400 to set a color document on a contact glass 32 of the scanner 1300, and close the ADF 1400 to press down the color document. Then, the user turns on a start button of the color copier 1000. If the document is set on the ADF 1400, the color copier 1000 conveys the document to the contact glass 32, and then drives the scanner 1300 to activate a first travelling body 33 and a second travelling body 34. If the document is set on the contact glass 32, the color copier 1000 promptly drives the scanner 1300 to activate the first travelling body 33 and the second travelling body 34. In the color copier 1000, the first travelling body 33 not only allows light to be emitted from a light source, but also reflects reflected light from a document surface toward the second travelling body 34. The reflected light reflects off a mirror of the second travelling body 34, and then enters a reading sensor 36 via an imaging lens 35. Accordingly, the document is read.

When the start button is turned on, the transfer belt 10 is rotated clockwise by a drive motor as a drive unit. At the same time, the photoconductors 40Bk, 40C, 40M and 40Y of the respective process cartridges 18Bk, 18C, 18M, and 18Y are rotated, so that toner images of the respective colors of black, cyan, magenta, and yellow are formed on the photoconductors 40Bk, 40C, 40M, and 40Y. In the color copier 1000, the single-color images are sequentially transferred to the transfer belt 10 while the transfer belt 10 is moving, thereby forming combined color images on the transfer belt 10.

When the start button is turned on, the color copier 1000 selects and rotates one of sheet feeding rollers 42 to feed sheets P from of one of a plurality of sheet feed cassettes 44 in a sheet bank 43. The sheets P fed from the sheet feed cassette 44 are separated one by one by a separation roller 45, and the separated sheet P is conveyed to a sheet feed path 46. The sheet P is further conveyed by a conveyance roller 47 and guided to a sheet feed path 48 inside the copier body 1100. When the sheet P contacts a registration roller 49, the conveyance of the sheet P temporarily stops. Alternatively, sheets P on a manual tray 51 may be fed. In such a case, the color copier 1000 rotates a sheet feed roller 50 to feed the sheets P on the manual tray 51. The sheets P fed from the manual tray 51 are separated one by one by a separation roller 52, and the separated sheet P is conveyed to a manual sheet feed path 53. When the sheet P contacts the registration roller 49, the conveyance of the sheet P temporarily stops as similar to the sheet P fed from the sheet feed cassette 44. When the registration roller 49 is rotated to time with arrival of the combined color images on the transfer belt 10 at the secondary transfer portion 22, the sheet P is fed to the secondary transfer portion 22 between the transfer belt 10 and the secondary transfer roller 23. In the secondary transfer portion 22, the combined color images collectively transfer to the sheet P. In a case where a single-color copy needs to be made, a single-color toner image is formed and then transferred to the transfer belt 10. The single-color toner image on the transfer belt 10 is transferred to a sheet P in the secondary transfer portion 22.

The sheet P with the transferred toner image is conveyed from the secondary transfer portion 22 to the fixing device 25. After the fixing device 25 fixes the toner image on the sheet P by applying heat and pressure, a switching pawl 55 switches a conveyance direction of the sheet P an ejection roller 56. Then, the sheet P is ejected and stacked on a sheet ejection tray 57 by the ejection roller 56. Alternatively, the switching pawl 55 may switch a conveyance direction of the sheet P with the transferred toner image to the sheet reverse unit 28. In such a case, the sheet P is reversed by the sheet reverse unit 28, and the reversed sheet P is guided to the secondary transfer portion 22 again. After an image is transferred to a back surface of the sheet P, the ejection roller 56 ejects the sheet P to the sheet ejection tray 57. The transfer cleaner 17 removes residual toner remaining on the transfer belt 10 subsequent to the transfer of the image, and the transfer belt 10 becomes ready for next image formation, which is performed by the tandem image forming unit 20.

In the exemplary embodiment, the transfer belt 10 includes a single layer or a multi-layer made of a material such as polyvinylidene difluoride (PVDF), ethylene tetrafluoroethylene (ETFE), polyimide (PI), and polycarbonate (PC). A surface of the transfer belt 10 can be coated with a release layer as necessary. Moreover, an elastic belt including a rubber layer may be used as the transfer belt 10. Since the elastic belt as the transfer belt 10 can be deformed, the use of the elastic belt enables clearance generated by a sheet P having asperities to be filled in the secondary transfer portion 22. Hence, the use of the elastic belt can provide good transferability. In a case where the elastic belt including only a rubber layer is employed, the belt can be excessively stretched. Thus, the transfer belt 10 may include a resin layer such as a polyimide layer (PI layer) in a base layer. Moreover, the transfer belt 10 may include a layer having a low friction coefficient in a surface layer.

Next, the transfer unit 500 is described in detail.

Figure 2:
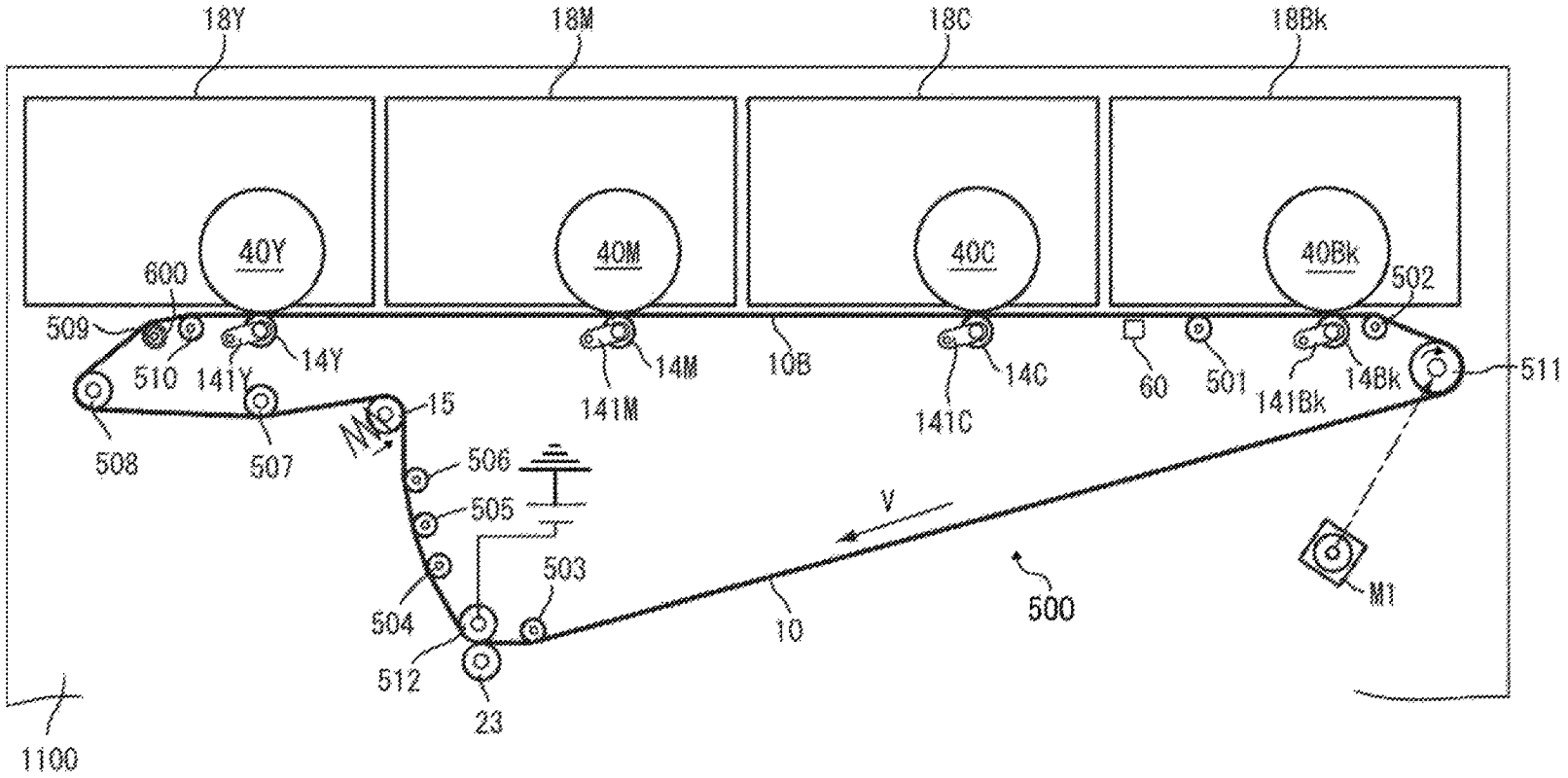
FIG. 2 is an enlarged view illustrating a configuration of a transfer unit as the belt device.
Figure 3:
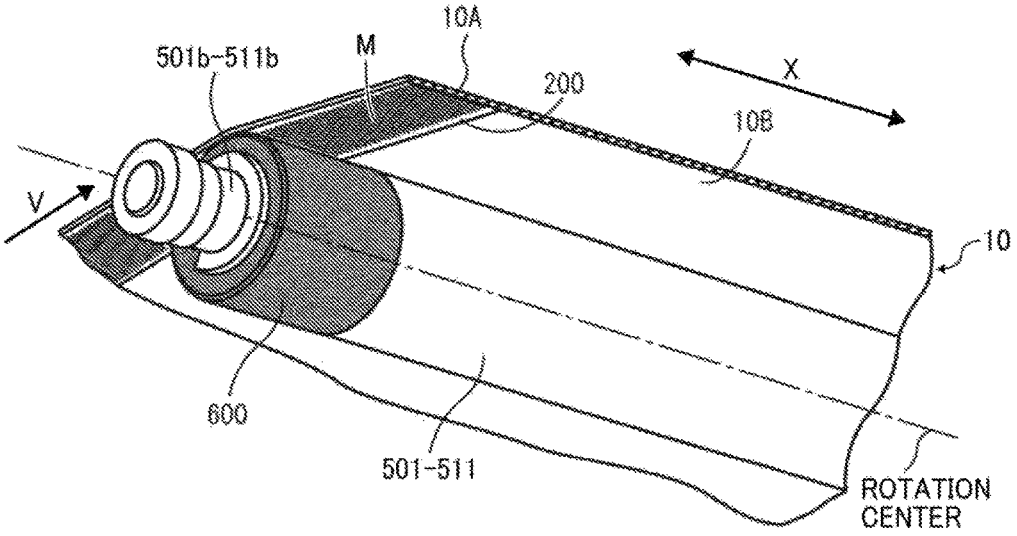
FIG. 3 is an enlarged partial view of a contact area between a belt member, a roller, and a cleaner as seen from a belt inner side.

FIG. 2 is a schematic diagram illustrating the process cartridges 18Bk, 18C, 18M, and 18Y and the transfer unit 500 as seen from a front side of the copier body 1100. The transfer unit 500 includes first through eleventh rollers 501 through 511 as a plurality of supporting members, the secondary transfer counter roller 512 as a supporting member, and the transfer belt 10 looped around the rollers 501 through 512. The rollers 501 through 511 are attached to outer circumferences of respective roller shafts 501*b* through 511*b* as illustrated in FIG. 3, and are rotated together with the respective roller shafts 501*b* through 511*b*. In FIG. 2, the roller 511 and the roller 508 are respectively arranged on the far-right side and the far-left side of the copier body 1100. In the exemplary embodiment, the roller 511 serves as a drive roller, whereas each of the rollers 501 through 510 serves as a driven roller. In FIG. 2, the roller 511 is rotated clockwise by a drive motor M1 as a drive source. The rotation of the roller 511 moves the transfer belt 10 at a predetermined speed. A tension roller 15 as a supporting member and a tension application rotator is disposed between the rollers 506 and 507. The tension roller 15 applies tension to the transfer belt 10 by urging the transfer belt 10 toward a belt inner side. The tension roller 15 is constructed as an elastic roller including a cored bar and a rubber layer around the cored bar.

The transfer belt 10 is disposed opposite the photoconductors 40Bk, 40C, 40M, and 40Y of the respective process cartridges 18Bk, 18C, 18M, and 18Y on the upper side of the transfer belt 10 looped between the rollers 511 and 508. The secondary transfer counter roller 512 is a rubber roller including a cored bar and a rubber layer around the cored bar, and a secondary transfer bias is applied to the cored bar. In the exemplary embodiment, the application of the secondary transfer bias is performed such that a voltage with current that is maintained constant is applied.

On the upper side of the transfer belt 10 in FIG. 2, primary transfer rollers 14Bk, 14C, 14M, and 14Y as primary transfer rotators are arranged on an inner side of the transfer belt 10 and opposite the respective photoconductors 40Bk, 40(7., 40M, and 40Y. The primary transfer rollers 14Bk, 14C, 14M, and 14Y are rotatably supported by respective supporting arms 141Bk, 141C, 141M, and 141Y that are known contact-separation mechanisms. Each of the supporting arms 141Bk, 141C, 141M, and 141Y vertically swings in FIG. 2. An electric actuator or a cam adjusts an angle of each of the supporting arms 141Bk, 141C, 141M, and 141Y, so that the supporting arms 141Bk 141C, 141M, and 141Y contact and separate from the transfer belt 10. Each of the primary transfer rollers 14Bk, 14C, 14M, and 14Y is a rubber roller including a cored bar and a rubber layer around the cored bar, and a primary transfer bias is applied to each of the cored bars. In the exemplary embodiment, the application of the primary transfer bias is performed such that a voltage with current that is maintained constant is applied.

As illustrated in FIG. 3, the transfer belt 10 includes a scale tape 200 as a detection target across a longitudinal direction of the transfer belt 10. The scale tape 200 is disposed in at least an end portion 10A that is one end portion in a belt width direction X intersecting with the belt movement direction V and on an inner surface 10B that is a side opposite each of the rollers. The scale tape 200 as the detection target is disposed extending along the belt movement direction V in the end portion 10A which is at least one side of the transfer belt 10 in the belt width direction X intersecting with the belt movement direction V.

Figure 4:
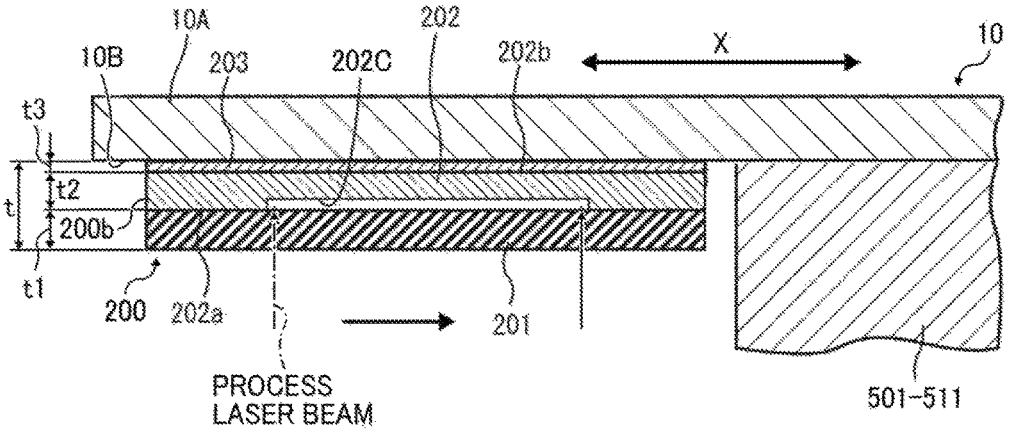
FIG. 4 is an enlarged sectional view illustrating one example of a configuration of a tape-shaped detection target disposed on the belt member.

The scale tape 200 includes three layers of a protective layer 201 having an insulation property, a conductive metal layer 202, and an adhesive layer 203 that are laminated as illustrated in FIG. 4. The scale tape 200 is attached to the inner surface 10B of the transfer belt 10 by an adhesive force of the adhesive layer 203. That is, the scale tape 200 is integrated with the transfer belt 10. The conductive metal layer 202 is a metal deposition film formed by depositing a conductive metal such as aluminum on an insulation film made of, for example, polyethylene terephthalate (PET) having an insulation property which is retained by the protective layer 201. The scale tape 200 includes the protective layer 201 provided on one surface 202*a* of the metal layer 202, and the adhesive layer 203 provided on the other surface 202*b* of the metal layer 202. In FIG. 4, each of the layers 201 through 203 is exaggerated for the sake of illustration of the scale tape 200. The scale tape 200 has an asperity portion 202C. For example, when a process laser beam is emitted by a laser beam machine and directed onto the metal layer 202 from a protective layer 201 side, the metal layer 202 is partially melted by the laser beam and thus the asperity portion 202C is formed.

Figure 6A:
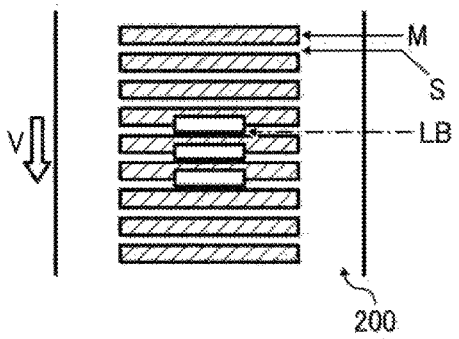
FIGS. 6A, 6B, and 6C are diagrams illustrating a configuration of the optical detector.

As illustrated in FIGS. 4 and 6A, the asperity portions 202C each having the substantially the same length are not only arranged parallel to and equidistant from each other, but also arranged with a small pitch along the belt movement direction V. Such arrangement is provided on the entire circumference of the transfer belt 10, so that scale marks M are formed as a detection area to be read by an optical detector. As illustrated in FIG. 4, where thicknesses of the scale tape 200, the protective layer 201, the metal layer 202, and the adhesive layer 203 are respectively represented by t, t1, t2, and t3, the thickness t1 is preferably 10 μm or more and the thickness t2 is preferably 10 μm or more. In the exemplary embodiment, the scale tape 200 has the thicknesses t1 of 25 μm, the thickness t2 of 25 μm, and the thickness t3 of 5 μm. That is, an end portion of the transfer belt 10 is thicker than other portions by the thickness t of the scale tape 200. In the exemplary embodiment, the scale tape 200 is attached to the inner surface 10B of the transfer belt 10, but is not limited to the attachment. For example, a scale mark M may be directly formed on the inner surface 10B of the transfer belt 10 by a laser beam machine. In the exemplary embodiment, the scale tape 200 is disposed on the entire circumference of the transfer belt 10. However, the scale tape 200 may be disposed On one portion in a movement direction of the transfer belt 10.

Figure 5:
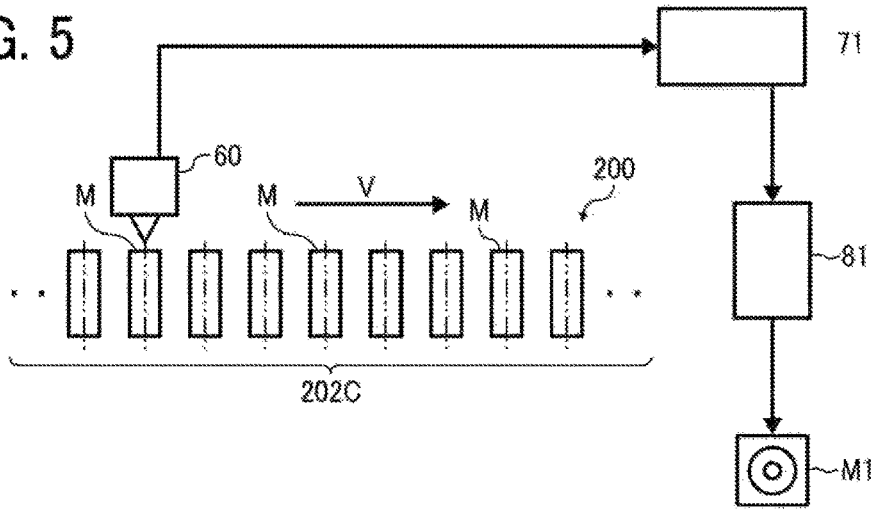
FIG. 5 is a diagram illustrating arrangement of an optical detector that detects the tape-shaped detection target.

In FIG. 5, a scale mark sensor (hereinafter called a scale sensor) 60 of an optical detector is arranged opposite the scale mark M. The scale sensor 60 is connected to a drive controller 71 via a signal wire. The scale sensor 60 successively detects the scale marks M on the transfer belt 10, and outputs detection signals to the drive controller 71. That is, the scale sensor 60 has the function of detecting the scale tape 200 as the detection target and the function of reading the scale tape 200. The drive controller 71 is connected to the drive motor M1 via a motor drive circuit 81, and has the function of controlling an operation of the drive motor M to control a belt movement speed of the transfer belt 10. The drive controller 71 acquires position data used for pitch correction of the scale marks M based on the detection signals from the scale sensor 60, and inputs target position data to the motor drive circuit 81, thereby controlling the belt movement speed of the transfer belt 10. Accordingly, the drive controller 71 outputs a signal as necessary to the motor drive circuit 81 based on the position information of the transfer belt 10 detected by the scale sensor 60 to allow the motor drive circuit 81 to drive the drive motor M1, thereby performing feedback control of the belt movement speed of the transfer belt 10.

Figure 6B:
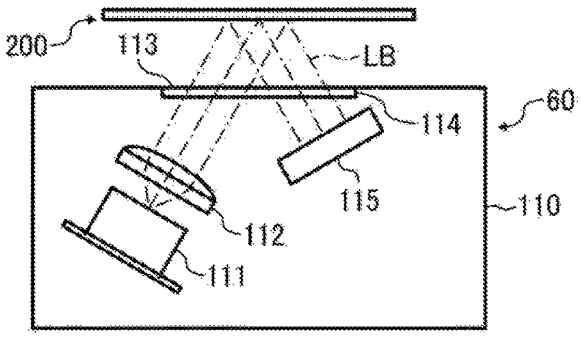
Figure 6C:
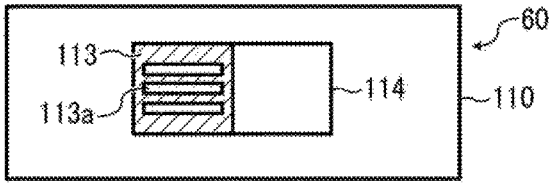

Detection of the scale marks M by the scale sensor 60 is described with reference to FIGS. 6A, 6B, and 6C. FIG. 6A is a plan view of the scale marks M on the scale tape 200. FIG. 6B is a perspective side view of an optical system and an optical path of the scale sensor 60, and FIG. 6C is a plan view of a detection surface of the scale sensor 60. The scale mark M is a reflective mark. As illustrated in FIG. 6A, the scale mark M as a reflection area and a light-shielding area S are alternately formed along the belt movement direction V on an outer circumferential surface of the transfer belt 10. The scale sensor 60 includes a light emitting element 111 such as a light emitting diode (LED), a collimate lens 112, a slit mask 113 (see FIG. 6B), a light receiving window 114 including a transparent cover such as a glass cover and a transparent resin film, and a light receiving element 115 such as a phototransistor. The light emitting element 111, the collimate lens 112, the slit mask 113, the light receiving window 114, and the light receiving element 115 are attached to respective portions in a casing 110. When the light emitting element 111 as a light source of the scale sensor 60 emits light, the light passes the collimate lens 112 to provide parallel light flux. As illustrated in FIG. 6C, the parallel light flux passes a plurality of slits 113*a* of the slit mask 113, the slits 113*a* being parallel to the scale marks M. After passing the slits 113*a*, the parallel light flux is split into a plurality of optical beams LB. Then, the scale tape 200 on the transfer belt 10 is irradiated with the optical beams LB. The scale marks M reflect one portion of the plurality of optical beams LB, and the reflected beam is received by the light receiving element 115 via the light receiving window 114. The light receiving element 115 converts a change in intensity (light and darkness) of the reflected light into an electric signal. Accordingly, the scale sensor 60 detects a change in intensity of the reflected light by using the light receiving element 115 to detect the scale mark M, and converts the present or absence of the scale mark M with the movement of the transfer belt 10 into analog alternating signals that are continuously modulated. Then, the scale sensor 60 outputs the analog alternating signals.

Figure 7:
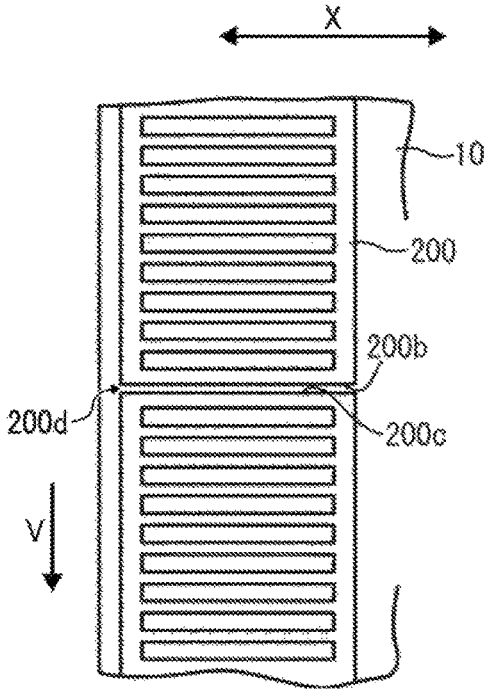
FIG. 7 is an enlarged view of a joint portion of the tape-shaped detection target disposed on the belt member.

Light reflectivity of the scale tape 200 disposed in the end portion of the transfer belt 10 may be markedly degraded due to stain, for example, paper powder or toner, associated with the use of the transfer unit 500. In such a case, a degree of degradation in light reflectivity of the scale tape 200 varies. If a light reflectivity of the scale tape 200 becomes lower than a certain light reflectivity of the scale sensor 60, the scale mark M on the scale tape 200 cannot be detected by the scale sensor 60. Such non-detection of the scale mark M is a reading failure. Consequently, in a case in which the scale mark M is not detected by the scale sensor 60, a movement speed of the transfer belt 10 cannot be accurately controlled. The uncontrolled movement speed of the transfer belt 10 may severely affect image forming (color shift). Hence, a stain on the scale tape 200 is desirably cleaned. If a cleaner is used to clean the scale tape 200, the cleaner can be disposed to contact the scale sensor 60. However, in a case in which there is a variation in relative positions of the cleaner and the scale sensor 60, such a variation can cause a cleaning failure. Thus, positional accuracy is needed. Moreover, the scale tape 200 is not an endless member. The scale tape 200 is formed by cutting a strip member and then attaching the cut strip member to the inner surface 10B in the end portion of the transfer belt 10. Hence, as illustrated in FIG. 7, a joint 200*d* is formed between an end portion 200*b* where the attachment begins and an end portion 200*c* where the attachment ends. In a case in which toner or paper powder enters the joint 200*d*, the toner or the paper powder causes an attachment failure of the scale tape 200. Consequently, the end portion 200*b* or 200*c* of the scale tape 200 is lifted from the transfer belt 10 over time. Such a lift can cause the lifespan of the scale tape 200 to end before a predetermined lifespan of the transfer unit 500 is reached, and thus replacement of the transfer belt 10 can be forced.

Figure 8:
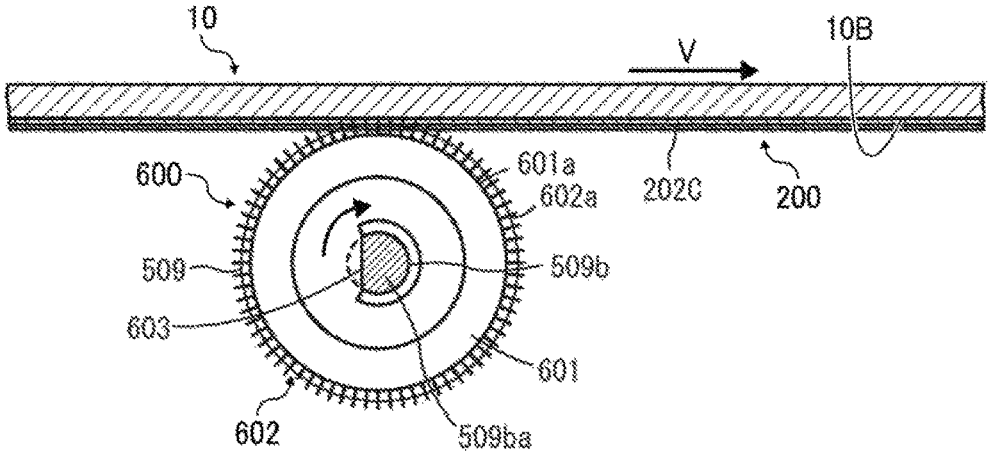
FIG. 8 is a diagram illustrating a configuration of the cleaner in the belt device according to the exemplary embodiment.

Hence, in the exemplary embodiment, as illustrated in FIG. 2, a rotatory cleaning brush roller 600 (illustrate in FIG. 8) is disposed on a side opposite the scale tape 200 and upstream of the scale sensor 60 in the belt movement direction V. The brush roller 600 includes a cylindrical cored bar 601 and a brush portion 602 as illustrated in FIG. 8. The brush portion 602 includes a plurality of fibers 602*a* disposed to radially project from a surface 601*a* as a circumferential surface of the cored bar 601 to contact the scale tape 200.

Figure 9A:
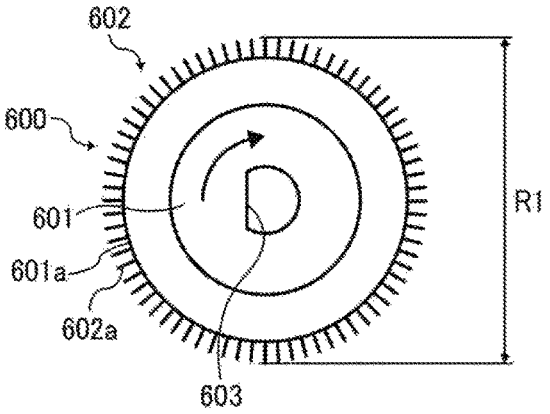
FIGS. 9A and 9B are diagrams respectively illustrating a configuration of a brush roller as the cleaner including a rotator, and a configuration of a supporting member on which the brush roller is disposed.
Figure 9B:
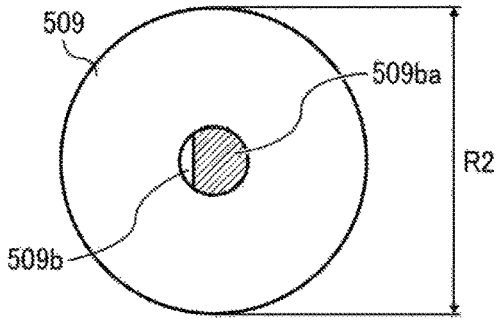

As illustrated in FIG. 9A, the cored bar 601 is formed such that a through-hole 603 having a D-shape in cross section in a middle portion of the cored bar 601 extends in the belt width direction X. Similar to the sectional shape of the through-hole 603, an end portion 509*ba* of a roller shaft 509*b* supporting a roller 509 has a D-shape in cross section as illustrated in FIG. 9B. Accordingly, the through-hole 603 is inserted into the end portion 509*ba* of the roller shaft 509*b*, so that the brush roller 600 is rotated together with the roller 509 as illustrated in FIG. 8. The brush portion 602 is pressed against the scale tape 200 such that a tip of the fiber 602*a* reaches a recessed portion of the asperity portion 202C. That is, the brush roller 600 is disposed on the roller shaft 509*b* of the roller 509 as at least one of the plurality of supporting members such that the brush roller 600 is rotated together with the roller 509. The fiber 602*a* of the brush portion 602 is made of a material such as synthetic resin fiber and conductive polyethylene terephthalate (PET) resin. In the exemplary embodiment, the fiber 602*a* made of conductive PET resin is implanted in the cored bar 601 to form the brush portion 602.

Accordingly, the brush roller 600 as a cleaner that contacts the scale tape 200 to clean the scale tape 200 is disposed on the roller shaft 509*b* of the roller 509 for supporting the transfer belt 10 which moves in the belt movement direction V, so that the brush roller 600 and the scale tape 200 are arranged via the roller shaft 509*b* of the roller 509 as a common supporting member. Such arrangement can enhance the positional accuracy of the brush roller 600 with respect to the scale tape 200. The roller 509 supports the transfer belt 10, and a position of the roller 509 is determined with good accuracy with respect to the inner surface 10B of the transfer belt 10. Since the brush roller 600 as the cleaner is disposed on the roller shaft 509*b* of the roller 509, a position of the brush roller 600 is determined with good accuracy with respect to the scale tape 200 disposed on the inner surface 10B of the transfer belt 10. The enhancement of positional accuracy reduces a reading failure (a detection failure) of the scale sensor 60 due to a cleaning failure, so that a movement speed of the transfer belt 10 is accurately controlled. Hence, the image forming (color shift) can be prevented from being severely affected.

As for the roller 509, an elastic roller including a cored bare coated with an elastic layer, or a metal roller without an elastic layer on a surface can be used. However, in the exemplary embodiment, a metal roller is used as the roller 509. The use of the metal roller as the roller 509 enables a distance between the roller shaft 509*b* and the inner surface 10B of the transfer belt 10 to be determined more accurately than the use of an elastic roller. Thus, the positional accuracy of the brush roller 600 with respect to the scale tape 200 can be further enhanced. Since the scale tape 200 is cleaned by the brush roller 600, the joint 200*d* (see FIG. 7) at the end portion of the scale tape 200 can be prevented from being lifted from the transfer belt 10, and durability of the scale tape 200 can be enhanced. Therefore, replacement of the transfer belt 10 can be prevented, and durability in a certain time targeted by the belt device can be maintained.

Since the rotator is used as the cleaner, the number of components and costs can be reduced. Since the brush roller 600 integrally rotatable with the roller shaft 509*b* is used as the cleaner, the brush roller 600 is rotated with the movement of the transfer belt 10 in the belt movement direction V. Herein, a contact area between each of the rollers and the transfer belt 10 is present across the belt width direction X. However, the contact area between the brush roller 600 and the transfer belt 10 is narrower in the belt width direction X than the contact area between each of the other rollers and the transfer belt 10. Moreover, since the brush roller 600 is rotated by friction generated by contacting the scale tape 200 instead of a drive source such as a motor, a linear velocity difference is generated between the transfer belt 10 and the brush roller 600. Thus, the brush portion 602 of the brush roller 600 can scrape toner and powder adhering to the scale tape 200, thereby reducing a reading failure (a detection failure) due to a cleaning failure. Accordingly, the movement speed of the transfer belt 10 can be controlled more accurately, and the image forming (color shift) can be further prevented from being severely affected. Moreover, durability in a certain time targeted by the belt device can be further maintained. Since the brush roller 600 is rotated with the movement of the transfer belt 10, a drive source for rotating the brush roller 600 is not necessary, and consideration of installation space for the drive source is not necessary. Since the brush roller 600 functions as the cleaner, the paper powder and the toner scraped from the scale tape 200 can be retained in the brush portion 602. Moreover, since the brush roller 600 and the roller 509 are separate members, an additional brush roller 600 can be readily attached to an optional roller disposed upstream of the scale sensor 60 in the belt movement direction V, and the brush roller 600 can be replaced.

As illustrated in FIGS. 9A and 9B, the brush roller 600 as a rotator is formed to have an outer diameter R1 larger than an outer diameter R2 of the roller 509. The outer diameter R1 of the brush roller 600 represents an outer diameter of the brush portion 602 when the brush portion 602 is not in contact with the scale tape 200. Thus, the brush portion 602 of the brush roller 600 attached to the roller shaft 509*b* digs into the asperity portion 202C of the scale tape 200, and adherents such as paper powder and toner adhering to the asperity portion 202C can be further scraped from the asperity portion 202C, thereby further reducing a reading failure (a detection failure) due to a cleaning failure. Therefore, a movement speed of the transfer belt 10 can be controlled more accurately, and the image forming (color shift) can be prevented from being severely affected. Moreover, durability in a certain time targeted by the belt device can be further maintained.

Figure 10:
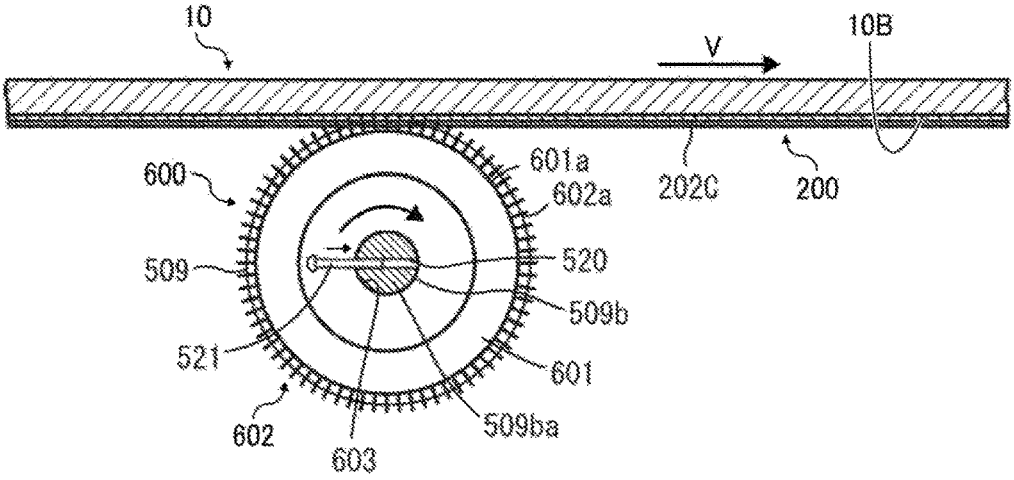
FIG. 10 is a diagram illustrating a modification example of the brush roller.
Figure 11:
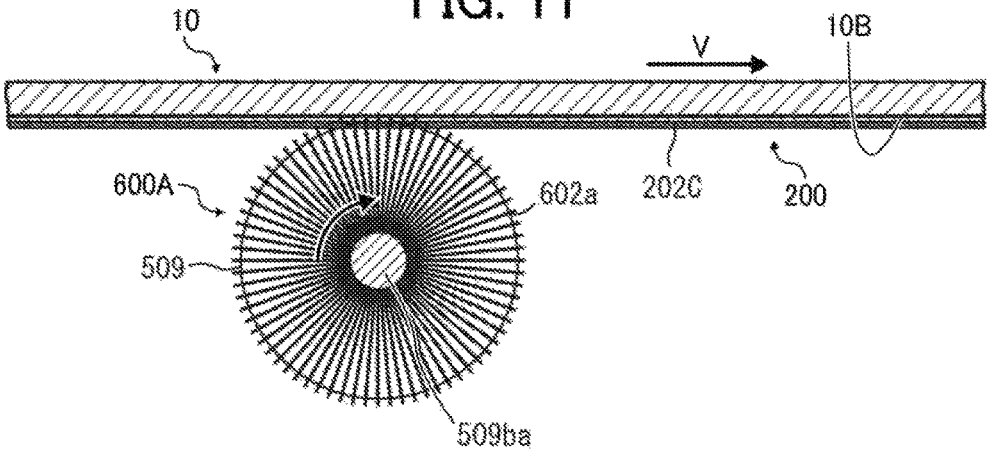
FIG. 11 is a diagram illustrating a modification example of the cleaner including the rotator.

In the exemplary embodiment, for integration of the brush roller 600 with the roller shaft 509*b*, the through-hole 603 of the cored bar 601 and the end portion 509*ba* of the roller shaft 509*b* have D-shape in cross section to lock the brush roller 600 and the roller shaft 509*b*. Moreover, an axial movement of the brush roller 600 and the roller shaft 509*b* is prevented using an E ring. However, the exemplary embodiment is not limited to such a configuration. For example, as illustrated in FIG. 10, a hole 520 may be formed to allow the through-hole 603 and the end portion 509*ba* of the roller shaft 509*b* to pass through in a diameter direction while a circular section of each of the through-hole 603 and the end portion 509*ba* of the roller 509 remains. Then, a pin 521 can be inserted into the hole 520 to not only lock the brush roller 600 from the roller shaft 509*b* but also prevent an axial movement of the brush roller 600 and the roller shaft 509*b*. Moreover, since a separate drive source for rotating the cleaner is not necessary, a component such as a driving gear is not necessarily disposed to the end portion 509*ba* of the roller shaft 509*b*. Hence, a space can be provided. Accordingly, as illustrated in FIG. 11, a cleaner 600A as a rotator can be constructed of fiber 602*a* directly implanted in the end portion 509*ba* of the roller shaft 509*b* and has a length that reaches the asperity portion 202C of the scale tape 200.

In the exemplary embodiment, as illustrated in FIG. 1, the color copier 1000 as an image forming apparatus includes the secondary transfer portion (the nip portion) 22 as a transfer portion to secondarily transfer an image (a toner image) on the transfer belt 10 to a sheet P as a recording medium. Moreover, as illustrated in FIGS. 1 and 2, the brush roller 600 is disposed downstream of the secondary transfer portion in the movement direction V of the transfer belt 10, and an upstream side of the scale sensor 60 in the belt movement direction V of the transfer belt 10. Such arrangement allows the scale tape 200 to be cleaned by the brush roller 600 before the scale tape 200 reaches the scale sensor 60 even if toner is scattered on the scale tape 200 by a secondary transfer process in the secondary transfer portion 22. Therefore, a reading failure (a detection failure) of the scale sensor 60 can be prevented.

It should be noted that the brush roller 600 may be disposed on an immediate upstream side of the scale sensor 60 in the belt movement direction V of the transfer belt 10 instead of the configuration illustrated in FIG. 2. That is, the scale sensor 60 is disposed downstream of primary transfer portions (in which the photoconductors 40Y, 40M, and 40C contact the transfer belt 10) as transfer areas arranged upstream of the brush roller 600 in the belt movement direction V. Accordingly, even if toner scattered by primary transfer process in the primary transfer portions is scattered on the scale tape 200, the brush roller 600 cleans the scale tape 200 before the scale tape 200 reaches the scale sensor 60. Therefore, a reading failure (a detection failure) of the scale sensor 60 can be more reliably 1prevented.

A brush roller 600 as a cleaner in a transfer unit 500 as a belt device according to another exemplary embodiment is described.

Figure 12:
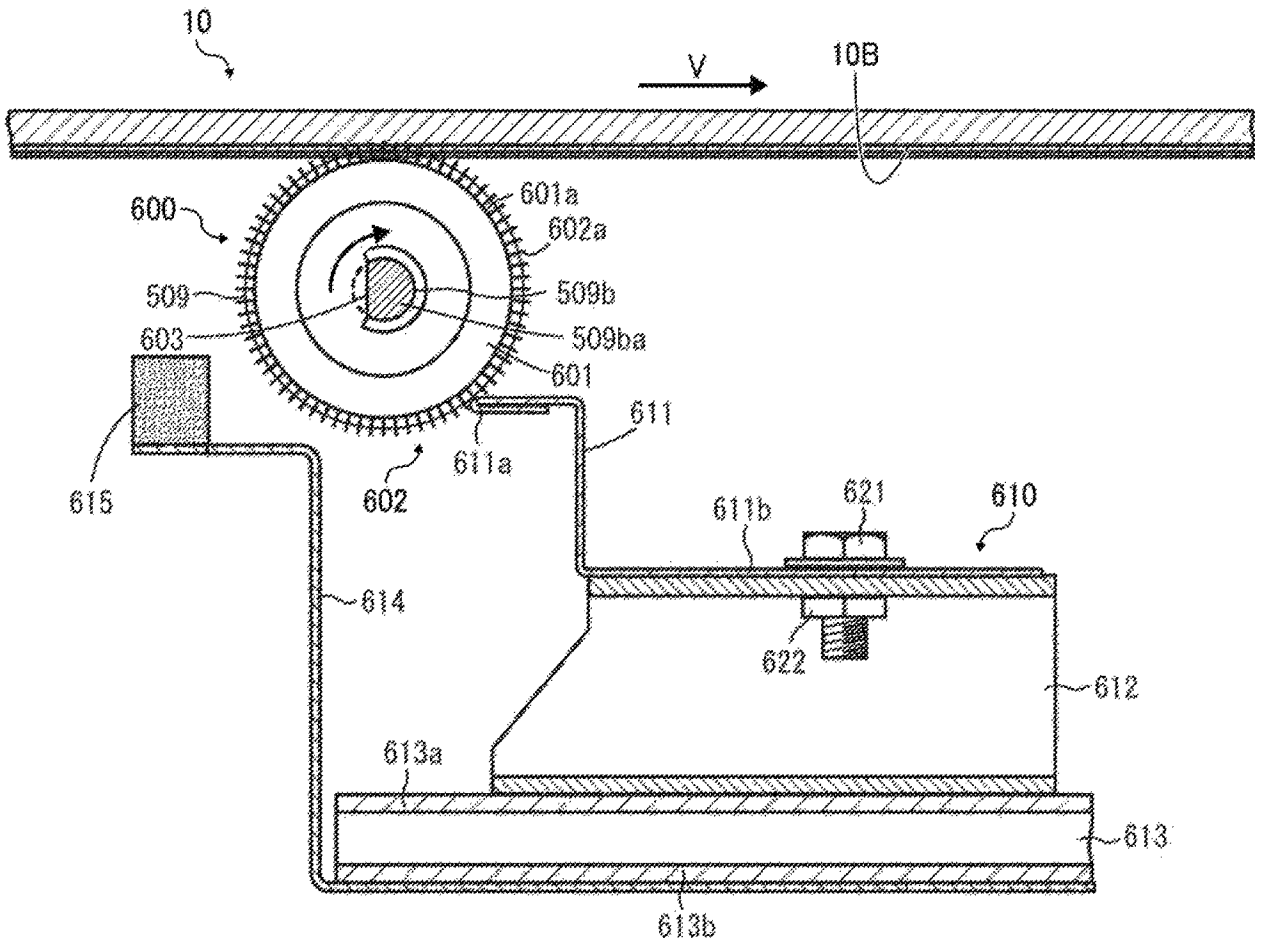
FIG. 12 is a diagram illustrating a configuration of a cleaner in a belt device according to another exemplary embodiment.

As illustrated in FIG. 12, the brush roller 600 includes a brush cleaning unit 610 in addition to the configuration of the clear according to the exemplary embodiment described above with reference to FIG. 8. The brush cleaning unit 610 contacts the brush roller 600 to clean the brush roller 600. The brush cleaning unit 610 includes a flicker 611 of a metal blade, and a holder 612 to which the flicker 611 is attached. The flicker 611 contacts a brush portion 602 of the brush roller 600. One end portion 611*a* of the flicker 611 contacts the brush portion 602, whereas the other end portion 611*b* of the flicker 611 is mounted on the holder 612 with a bolt 621 and a nut 622 of fasteners. The holder 612 is attached on a top 613*a* of a frame 613 of a transfer unit 500.

Figure 13:
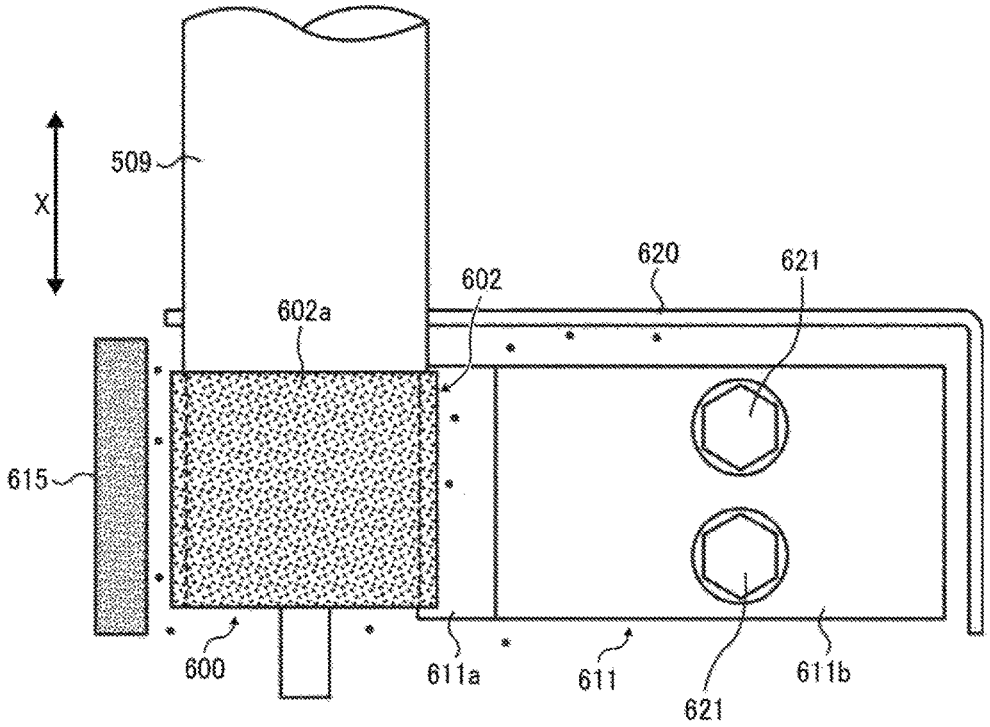
FIG. 13 is a plan view illustrating a configuration of the cleaner illustrated in FIG. 12.

As illustrated in FIG. 13, at least the end portion 611*a* of the flicker 611 extends in a belt width direction X to contact the entire area in the belt width direction X of the brush portion 602. As illustrated in FIG. 12, the end portion 611*a* of the flicker 611 is disposed to contact the brush portion 602 such that a tip of the end portion 611*a* is positioned between fiber 602*a* of the brush portion 602 and a surface 601*a* of a cored bar 601. The degree of contact between the end portion 611*a* of the flicker 611 and the brush portion 602 can be appropriately set according to materials of the end portion 611*a* of the flicker 611 and the fiber 602*a* of the brush portion 602. For example, a tip of the end portion 611*a* of the flicker 611 can contact the surface 601*a* of the cored bar 601.

Accordingly, the brush cleaning unit 610 is disposed to contact and clean the brush roller 600. When such a brush roller 600 rotates and passes the end portion 611*a* of the flicker 611, paper powder and toner accumulated in the brush portion 602 are flicked, thereby cleaning the brush roller 600. Thus, cleanability of the brush roller 600 can be maintained, and re-adhesion of paper powder and toner accumulated in the brush roller 600 to the scale tape 200 can be prevented. A reading failure (a detection failure) due to a cleaning failure can be further reduced. Hence, a movement speed of the transfer belt 10 can be controlled more accurately, and the image forming (color shift) can be prevented from being severely affected. Moreover, durability in a certain time targeted by the belt device can be further maintained.

In the exemplary embodiment, the transfer unit 500 as the belt device further includes shielding members 615 and 620 near the brush roller 600. The shielding member 615 is made of sponge. The shielding member 615 is mounted on a bracket 614 attached to a bottom 613*b* of the frame 613, and is positioned on a side opposite the end portion 611*a* of the flicker 611 with the brush roller 600 between the shielding member 615 and the end portion 611*a*. The shielding member 615 extends in the belt width direction X, and has a length longer than at least a length in the belt width direction X of the brush roller 600. As illustrated in FIG. 13, the shielding member 620 has an L-shape in a plan view. The shielding member 620 covers a side of the end portion 611*b* of the flicker 611, the flicker 611 from a middle portion relative to the brush roller 600 in the belt width direction X, and the brush roller 600. Since the periphery of the brush roller 600 and the periphery of the flicker 611 are covered with the shielding members 615 and 620, paper powder and toner indicated by bullet points illustrated in FIG. 13 scraped from the brush roller 600 by the flicker 611 is prevented from being scattered inside the belt device. Such arrangement prevents re-adhesion of the paper powder and toner to the scale tape 200 and the transfer belt 10. Therefore, a reading failure (a detection failure) due to a cleaning failure can be further reduced, and a movement speed of the transfer belt 10 can be stably controlled over time. Moreover, the image forming (color shift) can be prevented from being severely affected, and durability in a certain time targeted by the belt device can be further maintained. Moreover, since adhesion of scattered toner to the transfer belt 10 can be reduced, image quality can be enhanced.

A sponge roller 630 as a cleaner including a rotator for cleaning a scale tape 200 in a belt device according to another exemplary embodiment is described with reference to FIG. 14.

Figure 15A:
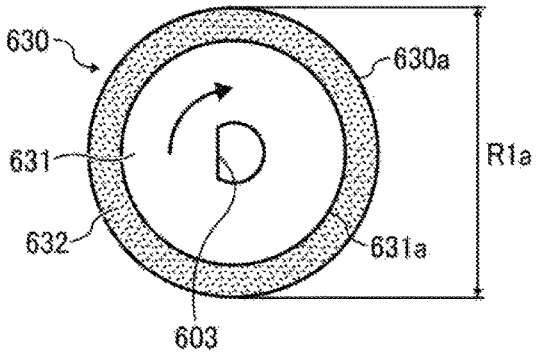
FIGS. 15A and 15B are diagrams respectively illustrating a configuration of a sponge roller as a cleaner made of foam and a configuration of a supporting member on which the sponge roller is disposed.
Figure 15B:
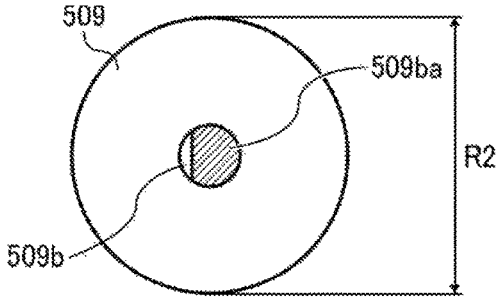

The sponge roller 630 is formed of foam such as sponge, and includes a cored bar 631 and a cylindrical sponge portion 632 attached to an outer circumference 631*a* of the cored bar 631. In a middle portion of the cored bar 631, a through-hole 603 is formed. The through-hole 603 is locked in an end portion 509*ba* of a roller shaft 509*b* such that the through-hole 603 and the end portion 509*ba* are attached in an integrally rotatable manner. In this case, as illustrated in FIGS. 15A and 15B, the sponge roller 630 as the rotator has an outer diameter R1*a* that is larger than an outer diameter R2 of the roller 509. The outer diameter R1*a* of the sponge roller 630 represents an outer diameter of the sponge portion 632 when the sponge portion 632 is not in contact with the scale tape 200. Accordingly, a surface 630*a* of the sponge roller 630 attached to the roller shaft 509*b* is deformed and digs into an asperity portion 202C of the scale tape 200, thereby removing adherents such as paper powder and toner adhering to the asperity portion 202C. Such removal of the adherents can further reduce a reading failure (a detection failure) due to a cleaning failure. Therefore, a movement speed of a transfer belt 10 can be controlled more accurately, and image forming (color shift) can be prevented from being severely affected. Moreover, durability in a certain time targeted by the belt device can be further maintained.

Figure 14:
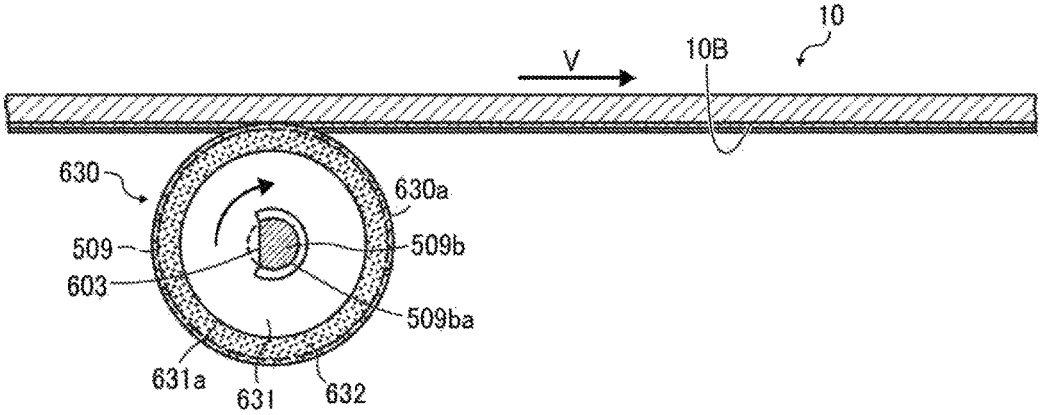
FIG. 14 is a diagram illustrating a configuration of a cleaner in a belt device according to another exemplary embodiment.
Figure 16:
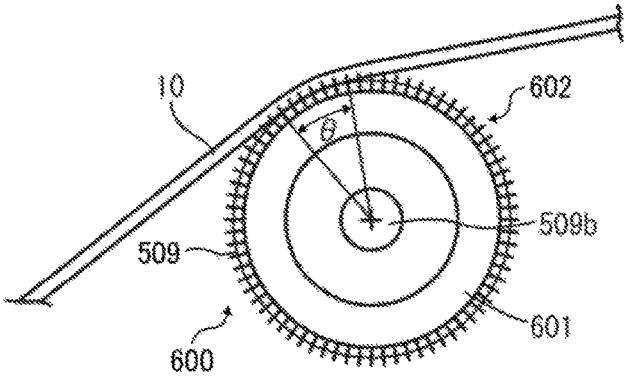
FIG. 16 is an enlarged view illustrating a winding angle between a roller as the supporting member and a belt member.

Since the brush roller 600 as the cleaner including the rotator described above with reference to FIGS. 8 and 12, or the sponge roller 630 as the cleaner including the rotator illustrated in FIG. 14 is rotated with the movement of the transfer belt 10 to clean the scale tape 200, reliable rotation of the brush roller 600 or the sponge roller 630 is important. A friction with the transfer belt 10 (the scale tape 200) is one element for reliable rotation of the brush roller 600 or the sponge roller 630. The friction between the transfer belt 10 and the brush roller 600 or the sponge roller 630 is affected by not only a coefficient of friction between materials of the transfer belt 10 and the brush roller 600 or the sponge roller 630 but also a winding angle θ of the transfer belt 10 with respect to the brush roller 600 or the sponge roller 630. Accordingly, the inventors have found that the brush roller 600 or the sponge roller 630 is reliably rotated if a winding angle θ is 10 degrees or more based on examinations in which a winding angle θ is gradually increased from zero degree while materials of the transfer belt 10 and the brush roller 600 or the sponge roller 630 remain constant. Therefore, in the cleaner including the rotator to be rotated with the movement of the transfer belt 10, the rotator preferably has the winding angle θ of 10 degrees or more, as shown in FIG. 16.

When the sponge roller 630 cleans the scale tape 200, paper powder or toner is accumulated on a surface 630*a* or inside bubbles of the sponge roller 630. In some cases, the sponge roller 630 needs to be cleaned to maintain cleanability. Hereinafter, a sponge roller 630 with a cleaning unit 640 in a belt device according to another exemplary embodiment is described.

Figure 17:
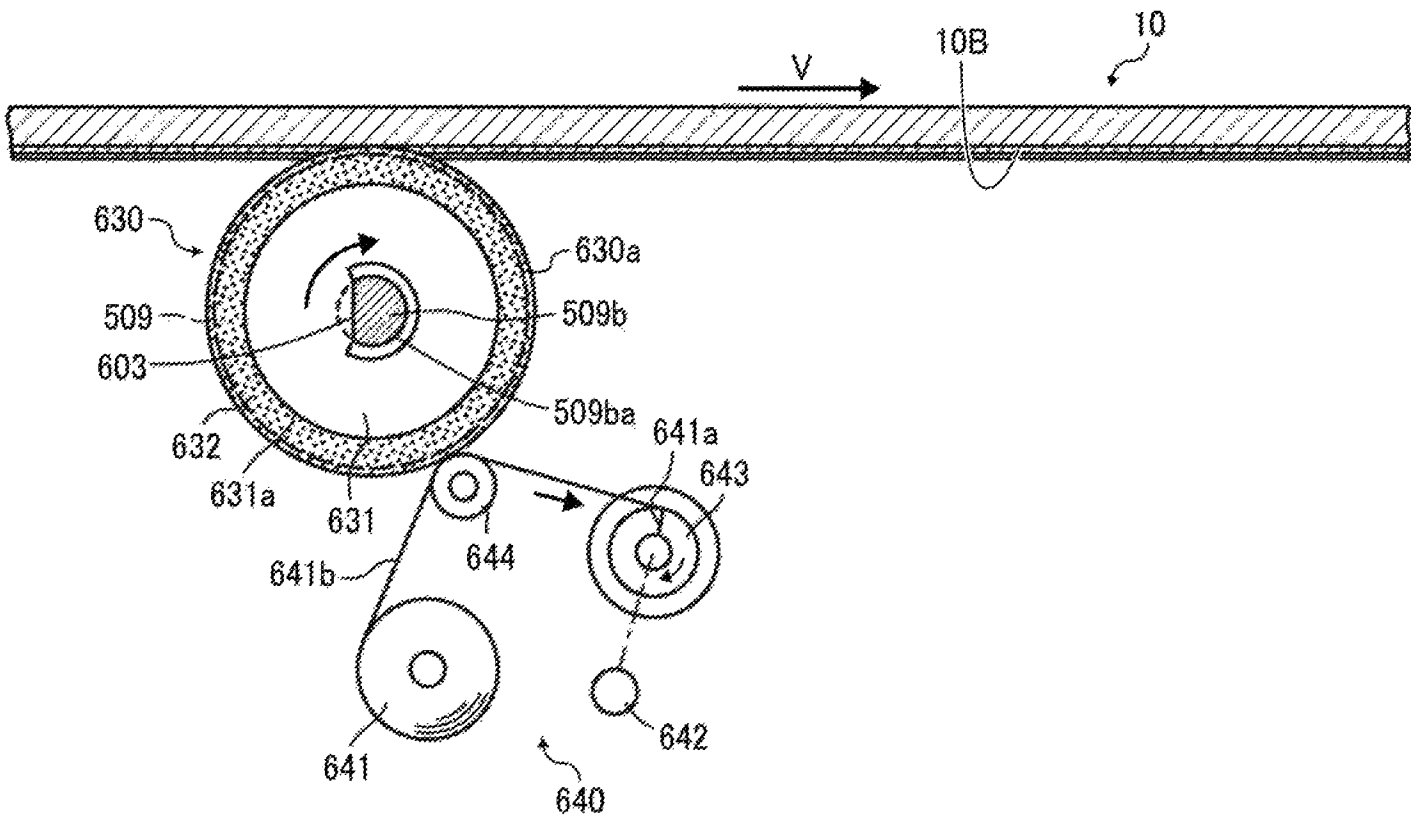
FIG. 17 is a diagram illustrating a configuration of a cleaner in a belt device according to another exemplary embodiment.

As illustrated in FIG. 17, the cleaning unit 640 contacts a surface 630*a* as a circumferential surface of the sponge roller 630 as a rotator to clean the sponge roller 630. The cleaning unit 640 includes a belt-shaped cleaning member 641 wound in a roll shape, a take-up pulley 643 on which an end portion 641*a* of the cleaning member 641 is mounted, and a tension roller 644. The take-up pulley 643 is rotated by a drive source 642 such as a drive motor. The tension roller 644 urges a pulled portion 641*b* of the cleaning member 641 to the surface 630*a* of the sponge roller 630. The cleaning member 641 and the take-up pulley 643 are spaced a certain distance apart, and the tension roller 644 is disposed such that the pulled portion 641*a* pulled out from the cleaning member 641 in a rolled state contacts or preferably presses against the surface 630*a* of the sponge roller 630 within the distance. The cleaning unit 640 activates the drive source 642 with respect to each predetermined time or each printing of the predetermined number of sheets to rotate the take-up pulley 643, so that the cleaning member 641 is pulled out from the rolled state to absorb paper powder and toner adhering to the sponge roller 630.

With the cleaning unit 640, which contacts the sponge roller 630 to clean the sponge roller 630, the cleaning ember 641 to contact the surface 630*a* of the sponge roller 630 rotated with the movement of a transfer belt 10 in a belt movement direction V is wound up by the take-up pulley 643. Thus, paper powder and toner adhering to the surface 630*a* of the sponge roller 630 can be cleaned. Accordingly, cleanability of the sponge roller 630 can be maintained, and paper powder and toner accumulated on the sponge roller 630 can be prevented from re-adhering to a scale tape 200. Hence, a reading failure (a detection failure) due to a cleaning failure can be further reduced. A movement speed of the transfer belt 10 can be controlled more accurately, and image forming (color shift) can be prevented from being severely affected. Moreover, durability in a certain time targeted by the belt device can be further maintained.

In the above exemplary embodiments, the cleaner including the rotator is rotated with the movement of the transfer belt 10. Hereinafter, rotation of a rotator using a drive motor according to another exemplary embodiment is described with reference to FIG. 18.

Figure 18:
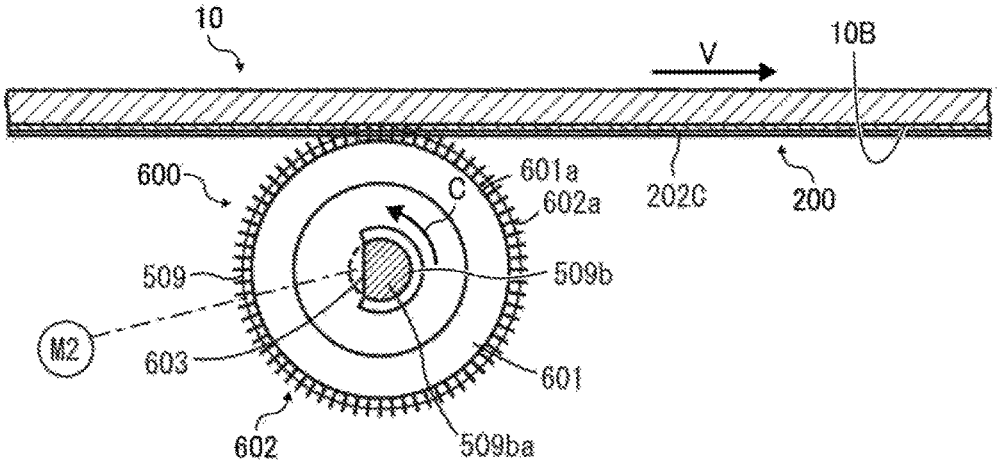
FIG. 18 is a diagram illustrating a configuration of a cleaner in a belt device according to another exemplary embodiment.
Figure 19:
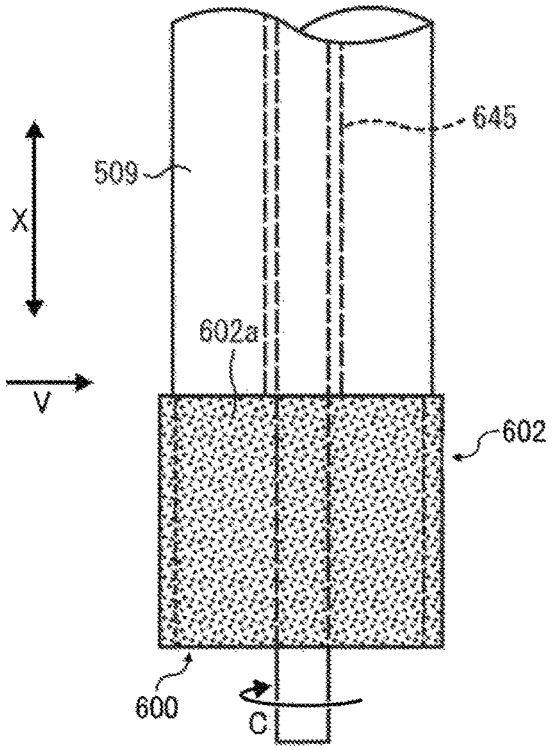
FIG. 19 is an enlarged view illustrating a configuration a roller as a supporting member and a shaft of the cleaner illustrated in FIG. 18.

In a belt device illustrated in FIG. 18, a cleaner including the rotator is rotated using a drive motor M2 as a drive unit for rotating a roller shaft 509*b* to rotate the cleaner. Although the exemplary embodiment illustrated in FIG. 18 is described using a brush roller 600 as the cleaner including the rotator, a sponge roller 630 can be used. The drive motor M2 rotates the roller shaft 509*b* in the reverse direction with respect to a belt movement direction V of a transfer belt 10. That is, the roller shaft 509*b* is rotated counterclockwise indicated by an arrow C illustrated in FIG. 18. Moreover, as illustrated in FIGS. 18 and 19, a one-way clutch 645 is disposed between the roller 509 and the roller shaft 509*b* including an end portion 509*ba* on which the sponge roller 630 is attached. The one-way clutch 645 functions in a direction in which the roller 509 is idled with respect to the roller shaft 509*b* when the roller shaft 509*b* is rotated in the counterclockwise direction C.

Accordingly, when the brush roller 600 is rotated in the reverse direction with respect to the belt movement direction V of the transfer belt 10, fiber 602*a* of a brush portion 602 presses against a scale tape 200 that integrally moves with the transfer belt 10 while the fiber 602*a* is rotating from a direction opposite with respect to the movement direction of the scale tape 200. Thus, adherents such as paper powder and toner adhering to an asperity portion 202C of the scale tape 200 can be scraped and cleaned with good efficiency. A reading failure (a detection failure) of the scale sensor 60 due to a cleaning failure can be further reduced, and a movement speed of the transfer belt 10 can be accurately controlled, thereby preventing image forming (color shift) from being severely affected. Moreover, since the roller 509 is idled with respect to the roller shaft 509*b* to be rotated, resistance to the transfer belt 10, which moves in the belt movement direction V, can be minimized.

In the above exemplary embodiment, the brush cleaning unit 610 including the flicker 611, or the cleaning unit 640 including the belt-shaped cleaning member 641 wound in a roll shape is used to remove paper powder and toner adhering to the rotator of the brush roller 600 or the sponge roller 630. However, when the brush cleaning unit 610 or the cleaning unit 640 cleans the rotator, paper powder or toner may be scattered with rotation of the cleaner. In such a case, there is concern that not only the transfer unit 500 as the belt device may become soiled, but also re-adhesion of paper powder or toner to the transfer belt 10 or the scale tape 200 may occur.

A description is now given of a cleaner including a cover 660 in a belt device according to another exemplary embodiment.

Figure 20:
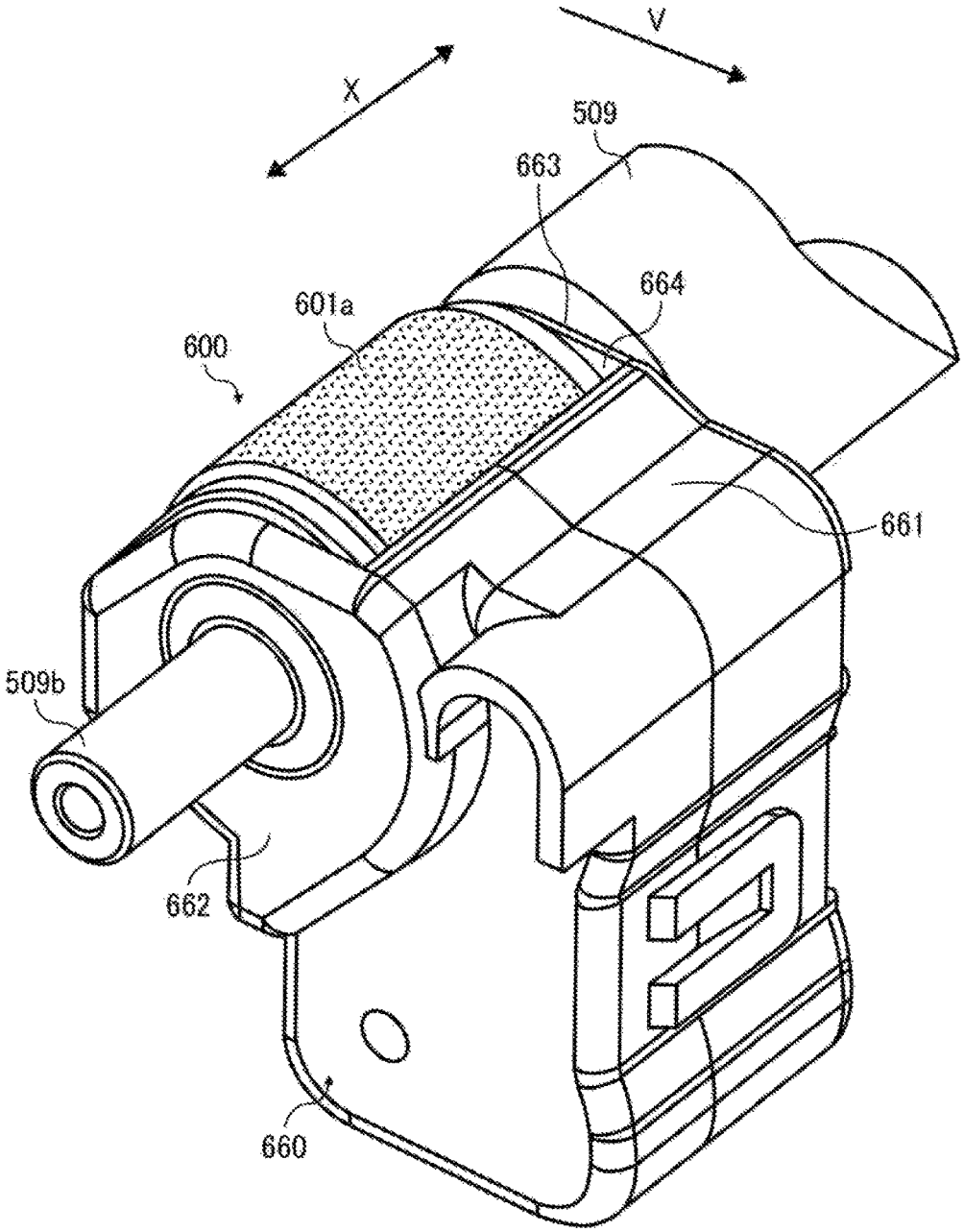
FIG. 20 is a diagram illustrating a configuration of a cleaner including a cover in a belt device according to another exemplary embodiment.

As illustrated in FIG. 20, the cover 660 covers at least the cleaner. The exemplary embodiment is described using a brush roller 600 as the cleaner. However, a sponge roller 630 can be used as the cleaner. The cover 660 includes an opening 664 on a top 661 disposed opposite a transfer belt 10, so that one portion of the cover 660 is opened. The cover 660 is formed as a case that is closed except for the opening 664. The cover 660 is attached to a frame of a transfer unit 500. The cover 660 includes side surfaces 662 and 663 arranged in a belt width direction X, and the side surfaces 662 and 663 rotatably support a roller shaft 509*b*. The cover 660 houses the brush, roller 600 attached to the roller shaft 509*b*.

Figure 21:
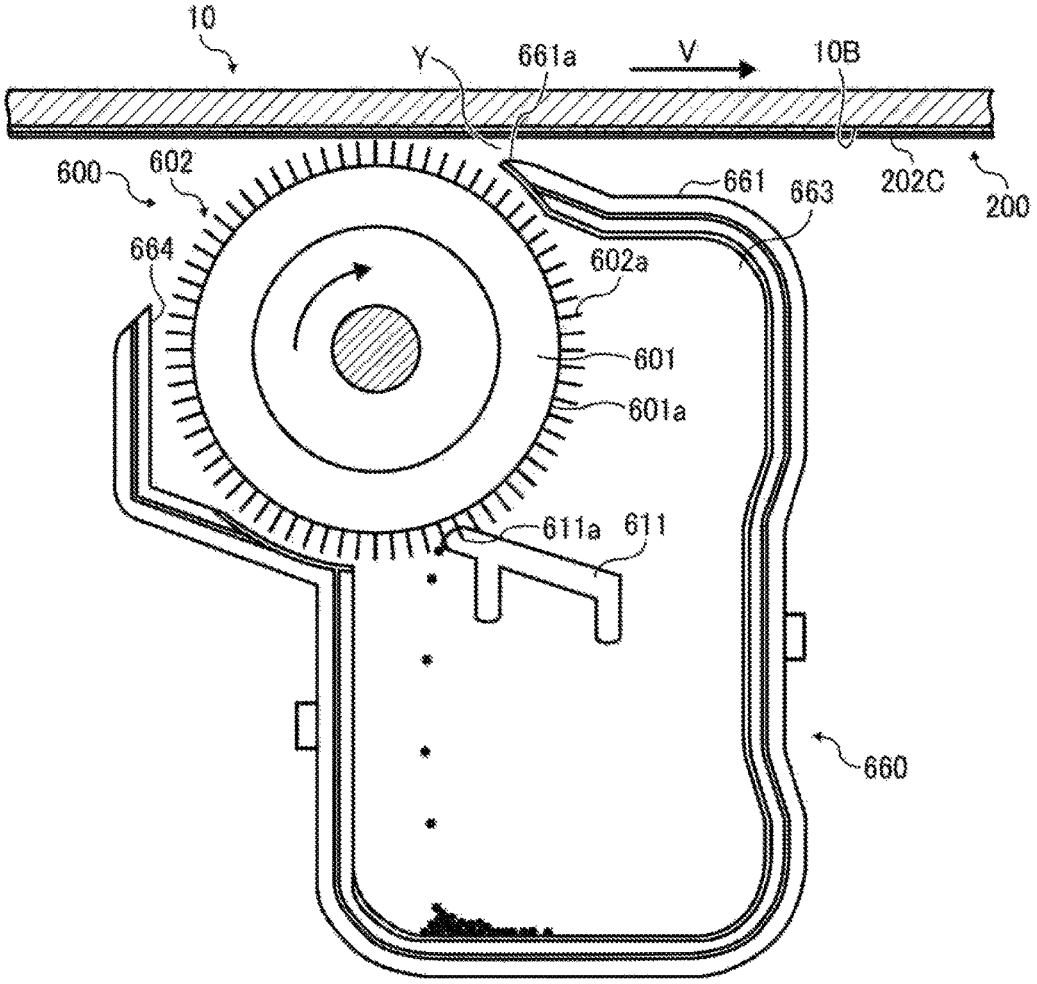
FIG. 21 is a sectional view illustrating a configuration and a function of the cover.

As illustrated in FIG. 21, one portion of a surface 601*a* as a circumferential surface of the brush roller 600 as the rotator is present inside the opening 664, and a brush portion 602 is exposed to the outside of the cover 660 from the opening 664. The brush portion 602 exposed to the outside is disposed such that fiber 602*a* of the brush portion 602 contacts or preferably presses against a scale tape 200. In the case-shaped cover 660, a flicker 611 of a brush cleaning unit 610 is attached such that an end portion 611*a* of the flicker 611 contacts the brush portion 602. That is, in the exemplary embodiment, the brush roller 600 and the periphery of the flicker 611 of the brush cleaning unit are covered with the cover 660 such that the periphery of the brush roller 600 and the periphery of the flicker 611 are protected. Moreover, in a case in which a sponge roller 630 of foam is used as a cleaner, at least the periphery of the sponge roller 630 is covered with the cover 660 so as to be protected. In a case in which a cleaner includes a cleaning unit 640 in addition to the sponge roller 630, the periphery of the sponge roller 630 and the periphery of the cleaning unit 640 are covered with the cover 660 so as to be protected.

With such a cover 660 covering the brush roller 600, paper powder and toner adhering to the brush roller 600 do not tend to be scattered inside the belt device. Moreover, in the exemplary embodiment, the flicker 611 cleaning the brush roller 600 is also disposed inside the cover 660. Such arrangement enables paper powder and toner scraped off by the flicker 611 to be less scattered than a case in which the cover 660 is not present. Hence, cleanability of the brush roller 600 can be maintained, and paper powder and toner accumulated on the brush roller $00 can be prevented from re-adhering or being scattered to the scale tape 200. Therefore, a reading failure (a detection failure) due to a cleaning failure can be further reduced, and a movement speed of the transfer belt 10 can be controlled more accurately. Moreover, image forming (color shift) can be prevented from being severely affected, and durability in a certain time targeted by the belt device can be maintained.

Each of the above exemplary embodiments has been described using a member including a rotator as a form of a cleaner for cleaning the scale tape 200. Hereinafter, a brush 650 as a cleaner for cleaning the scale tape 200 in a belt device according to another exemplary embodiment is described with reference to FIG. 22 and FIG. 23.

Figure 22:
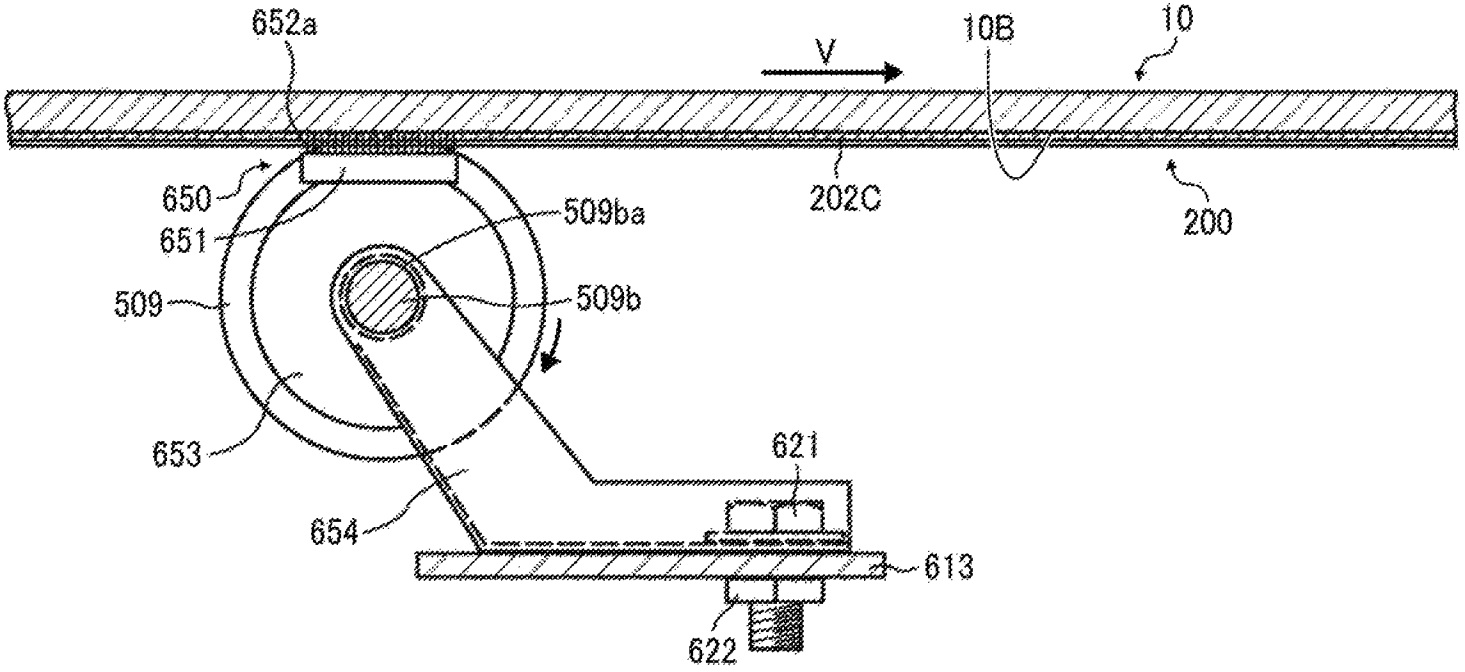
FIG. 22 is a diagram illustrating a configuration of a cleaner in a belt device according to another exemplary embodiment.
Figure 23:
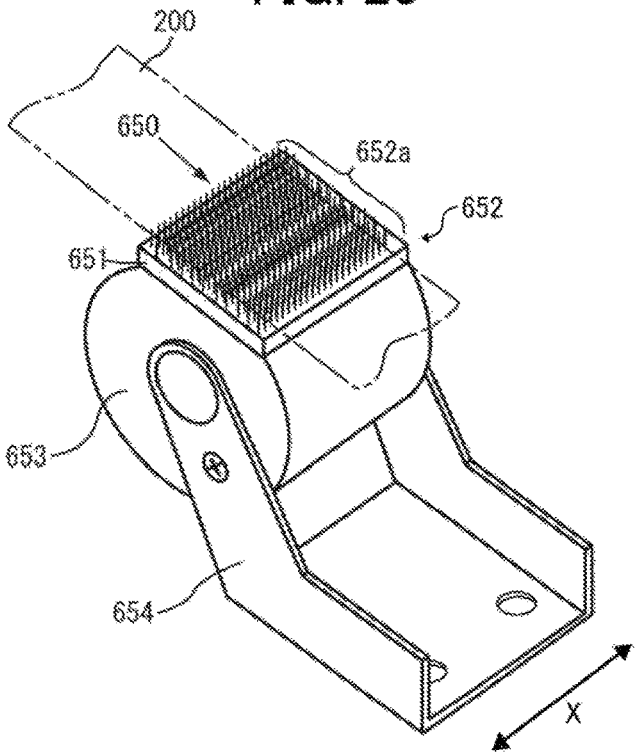
FIG. 23 is a schematic diagram illustrating a configuration of a plate member including fiber in the cleaner illustrated in FIG. 22.

The brush 650 includes a brush portion 652 with a plurality of fibers 652*a*, and a plate base 651 in which the fiber 652*a* is implanted. As illustrated in FIG. 23, the plate base 651 in which the plurality of fibers 652*a* is implanted is a metal plate or a resin plate extending in a belt width direction X. The brush 650 is formed such that a width in the belt width direction X of the brush 650 is greater than a width of the scale tape 200. As illustrated in FIG. 22, the brush 650 is attached to a collar 653 rotatably supported by an end portion 509*ba* of a roller shaft 509*b* such that tips of the plurality of fibers 552*a* press against an asperity portion 202C from a side opposite the scale tape 200. Since the collar 653 is supported by a bracket 654 attached to a frame 613, the collar 653 is not rotated with the rotation of the roller shaft 509*b* or the transfer belt 10. For example, the fiber 652*a* of the brush portion 652 is made of a material such as synthetic resin fiber and conductive polyethylene terephthalate (PET) resin. In the exemplary embodiment, the brush portion 652 includes the fiber 652*a* made of conductive PET resin, the fiber 652*a* being implanted in the plate base 651.

Accordingly, the brush 650 as the cleaner, which contacts the scale tape 200 to clean the scale tape 200, is disposed on the roller shaft 509*b* of the roller 509 supporting the transfer belt 10, which moves in the belt movement direction V. The brush 650 and the scale tape 200 are arranged via the roller shaft 509*b* of the roller 509 as a common supporting member, thereby enhancing positional accuracy of the brush 650 with respect to the scale tape 200. Such enhancement of the positional accuracy reduces a reading failure (a detection failure) of a scale sensor 60 due to a cleaning failure. Hence, a movement speed of the transfer belt 10 can be accurately controlled, and image forming (color shift) can be prevented from being severely affected. Since the scale tape 200 is cleaned by the brush 650, a joint 200*d* (see FIG. 7) between end portions of the scale tape 200 can be prevented from being lifted from the transfer belt 10. Moreover, durability of the scale tape 200 can be enhanced. Therefore, replacement of the transfer belt 10 can be reduced, and durability in a certain time targeted by the belt device can be maintained.

In the above exemplary embodiment, the scale tape 200 is attached to the end portion 10A of the inner surface 10B of the transfer belt 10. Before a description is given of a transfer belt 10 urged from a front surface 10C toward an inner surface 10B by a tension roller 15 according to another exemplary embodiment, a comparative example is described.

Figure 24:
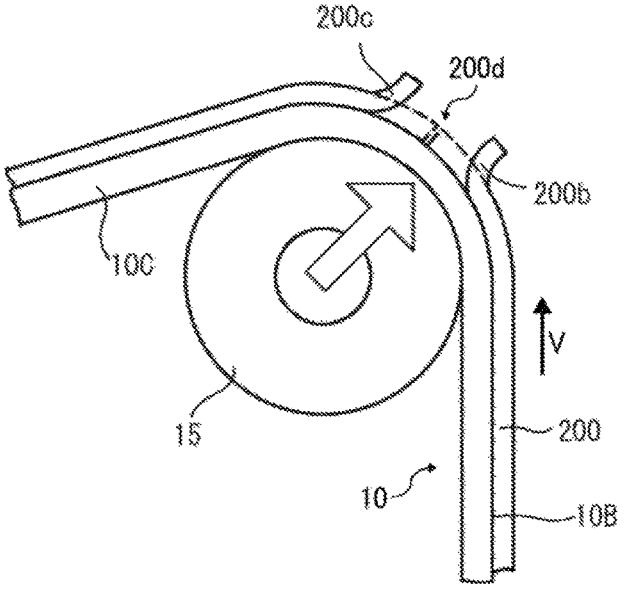
FIG. 24 is an enlarged view illustrating a problem that occurs in a joint of a tape-shaped detection target.
Figure 25:
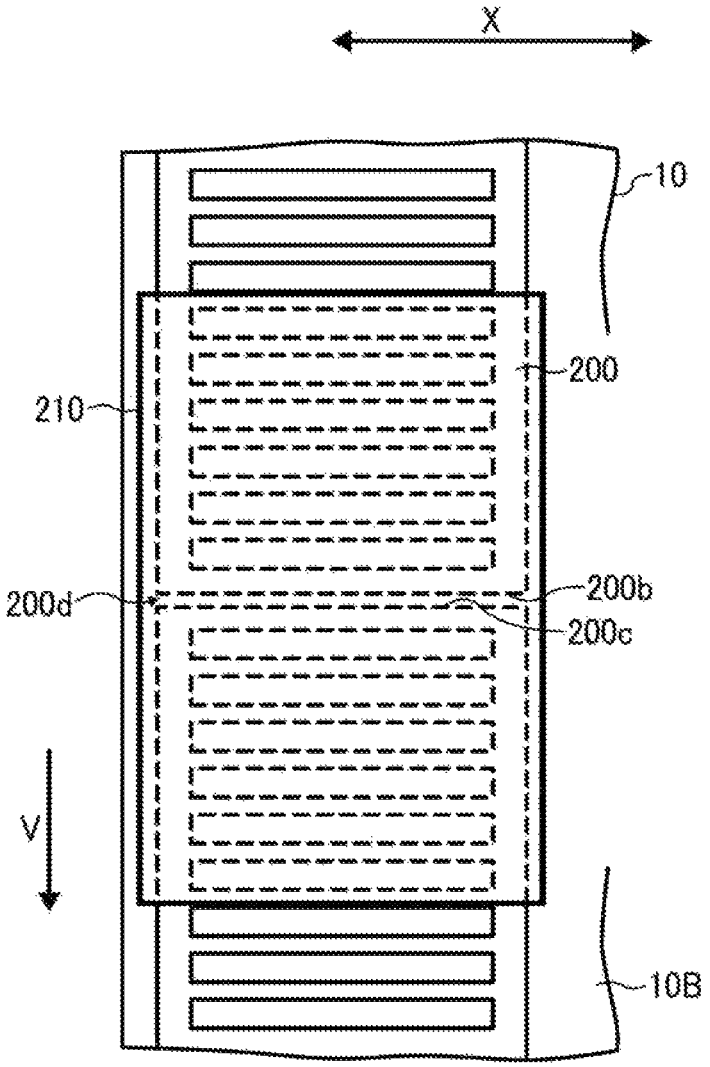
FIG. 25 is an enlarged view illustrating a state in which the joint of the tape-shaped detection target is reinforced.
Figure 26A:
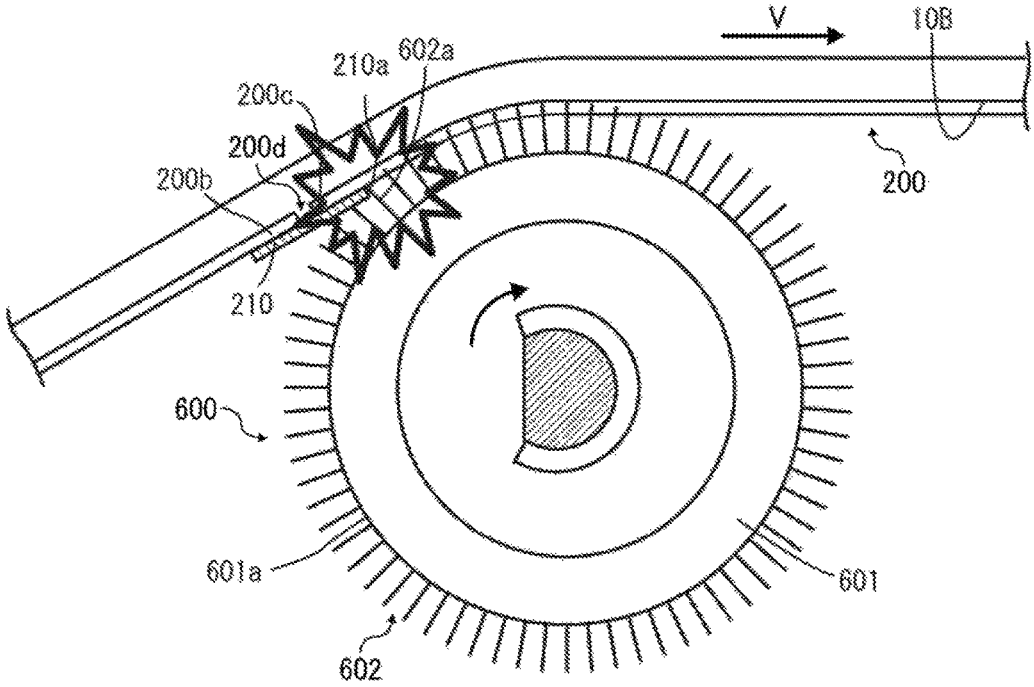
FIG. 26A is a diagram illustrating a problem of the reinforced portion of the joint and a brush cleaner.
Figure 26B:
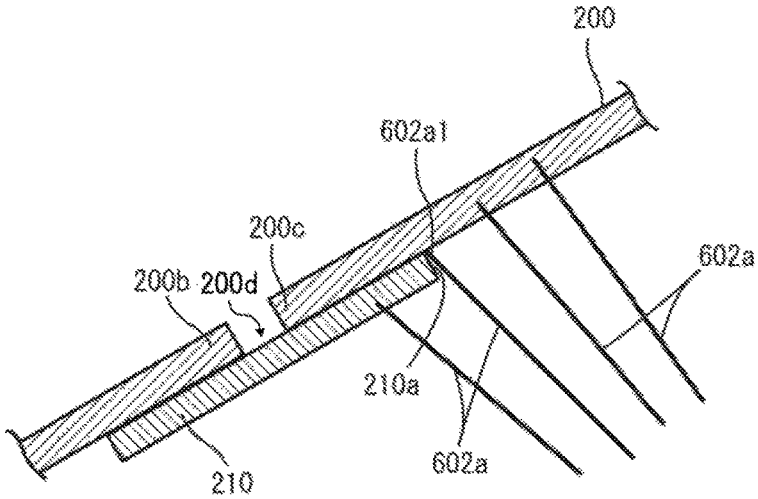
FIG. 26B is an enlarged partial view of FIG. 26A.

In the comparative example illustrated in FIG. 24, when a joint 200*d* of a scale tape 200 passes an area of the tension roller 15, the joint 200*d* is stretched by a force applied in an open direction with respect to the joint 200*d*. Such a stretch of the joint 200*d* may cause the joint 200*d* or an end portion 200*c* to be peeled from an inner surface 10B over time. Thus, illustrated FIG. 25, a reinforcing tape 210 as a sheet-shaped reinforcing member is affixed to cover an area including an end portion 200*b* and the end portion 200*c* of the scale tape 200 such that the joint 200*d* is not stretched. Such affixation of the reinforcing tape 210 can prevent the end portions 200*b* and 200*c* of the scale tape 200 from being peeled in the joint 200*d*. However, the use of the reinforcing tape 210 causes the area in which the reinforcing tape 210 is affixed (a thickness of an area near the joint 200*d*) to be thicker than other areas. As illustrated in FIGS. 26A and 26B, the use of the reinforcing tape 210 as a peeling prevention unit for the scale tape 200 may cause a tip 602*a*1 of the fiber 602*a* in the brush portion 602 of the brush roller 600 to be caught in a wedge manner in an end portion 210*a* of the reinforcing tape 210, when the area reinforced by the reinforcing tape 210 passes the brush roller 600 as the cleaner. In such a case, the reinforcing tape 210 can be peeled.

Figure 27A:
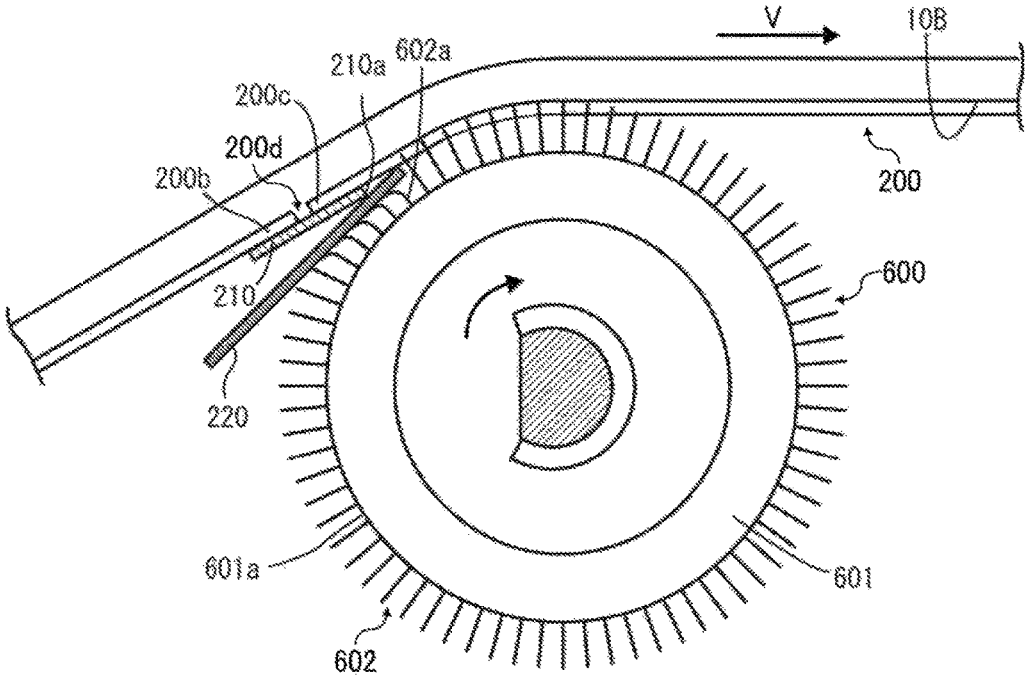
FIG. 27A is a diagram illustrating a configuration of a cleaner in a belt device according to another exemplary embodiment.
Figure 27B:
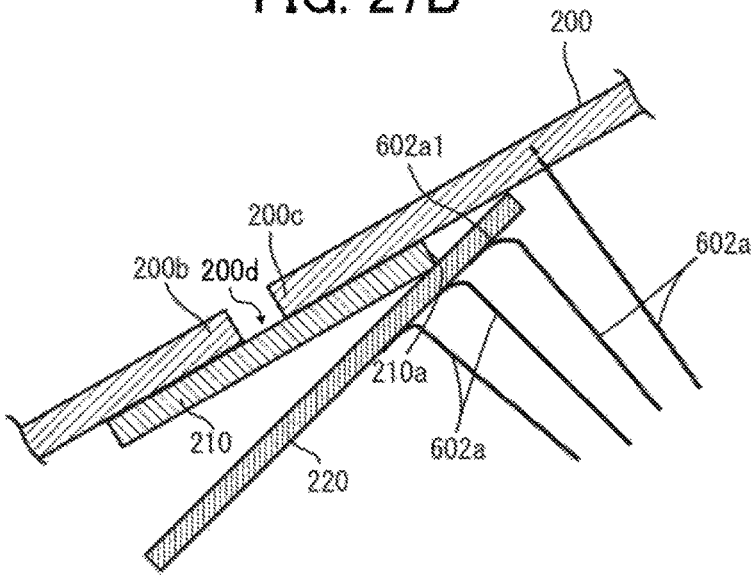
FIG. 27B is an enlarged partial view of FIG. 27A.
Figure 28:
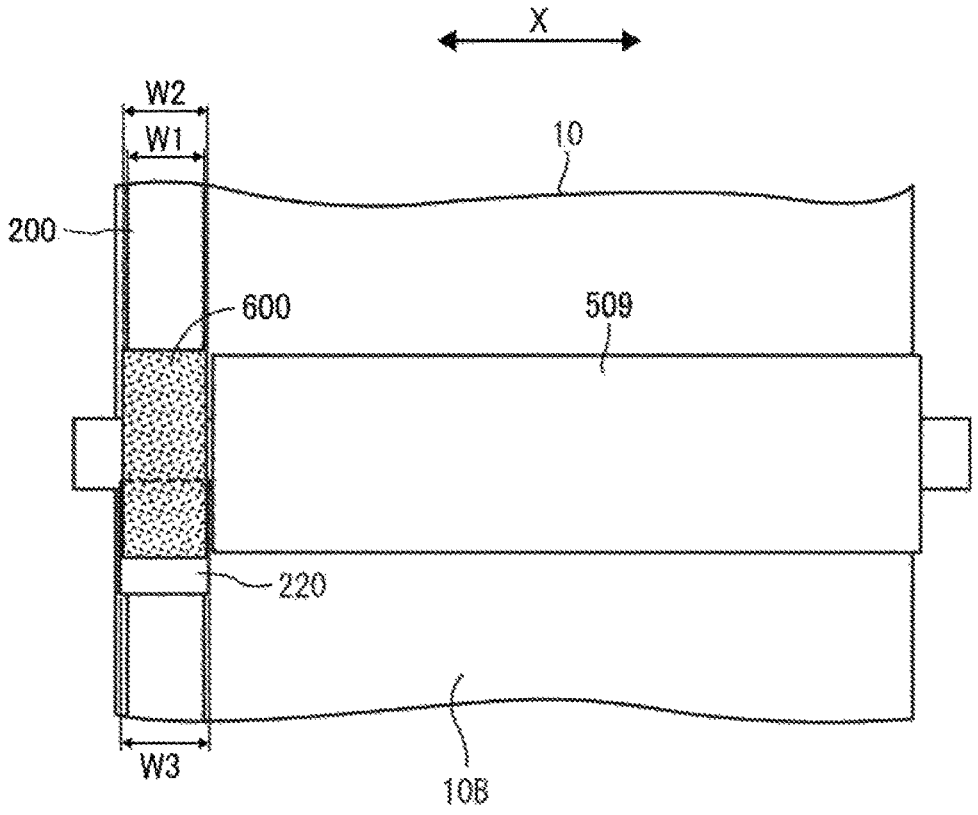
FIG. 28 is a diagram illustrating a relationship between a width of a tape-shaped detection target, a width of a protective member, and a width of the cleaner illustrated in FIG. 27A in a belt width direction.

Hence, in the exemplary embodiment, as illustrated in FIGS. 27A and 27B, a protective sheet 220 as a sheet-shaped protective member is disposed between the brush roller 600 and the reinforcing tape 210 so that the brush portion 602 is not caught in the end portion 210*a* of the reinforcing tape 210 even when the reinforced by the reinforcing tape 210 passes the brush roller 600. The protective sheet 220 has a width W3 in the belt width direction X. As illustrated in FIG. 28, the width W3 of the protective sheet 220 is greater than a width W1 of the scale tape 200 and a width W2 of the brush roller 600. Moreover, the width W2 of the brush roller 600 is greater than the width W1 of the scale tape 200. Such arrangement of the protect sheet 220 between the brush roller 600 and the reinforcing tape 210 allows the fiber 602*a* in the brush portion 602 of the brush roller 600 to be pressed toward the scale tape 200 (the transfer belt 10) via the protective sheet 220 when the reinforcing tape 210 passes the brush roller 600. Accordingly, the tip 602*a*1 of the fiber 602*a* is distorted and lies down, and thus the tip 602*a*1 is not caught in the end portion 210*a* of the reinforcing tape 210. Hence, the reinforcing tape 210 be prevented from being peeled off.

Figure 29:
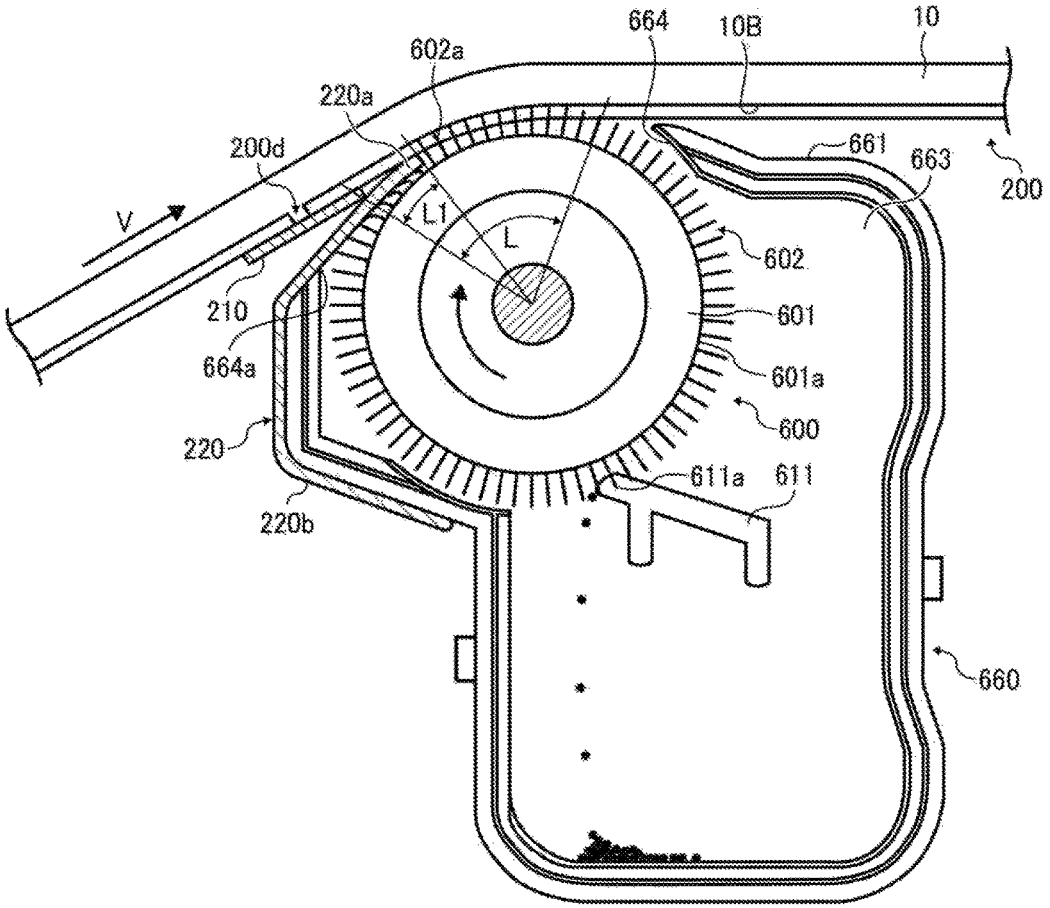
FIG. 29 is a diagram illustrating a state in which the protective member of the cleaner illustrated in FIG. 27A is disposed in the cleaner illustrated in FIG. 20.

The inventors have found, based on observation of peeling of the reinforcing tape 210 in a contact portion between the reinforcing tape 210 and the brush roller 600, that the tip 602*a*1 of the fiber 602*a* is caught in the end portion 210*a* if the fiber 602*a* of the brush portion 602 is standing at the time of entry of the end portion 210*a* of the reinforcing tape 210 into the brush portion 602 of the brush roller 600. Consequently, the protective sheet 220 is preferably disposed so as to enter into an installation area of the brush roller 600 from an upstream side of the installation area of the brush roller 600 in the belt movement direction V. Moreover, a cover 660 may be disposed to cover the brush roller 600 as described above with reference to FIG. 20. In such a case, as illustrated in FIG. 29, the protective sheet 220 can be affixed to the cover 660 such that the protective sheet 220 extends inside an opening 664 from an upstream side of the opening 664 in the belt movement direction V, the opening 664 allowing the brush roller 600 to be exposed to the outside from the cover 660. Such a protective sheet 220 can be disposed between the brush roller 600 and the reinforcing tape 210. That is, a second end portion 220*b* of the protective sheet 220 is attached on an outer surface of the cover 660 such that a first end portion 220*a* of the protective sheet 220 is positioned inside the opening 664 from an upstream side in the belt movement direction V. The protective sheet 220 is made of, for example, a soft resin material such as polyurethane and PET, and is preferably made of a material that does not damage the scale tape 200.

As illustrated in FIG. 29, the protective sheet 220 projects from an upstream end portion 664*a* of the opening 664 toward the brush roller 600. A projection amount of the protective sheet 220 is determined according to, for example, a length (a brush length) of the fiber 602*a* in the brush portion 602 of the brush roller 600, a hardness of the fiber 602*a* (brush), a material of the fiber 602*a* (brush), an insertion amount of the fiber 602*a* (brush) with respect to the scale tape 200, a friction coefficient of a surface of the scale tape 200, an adhesive strength between the scale tape 200 and the inner surface 10B of the transfer belt 10, and a thickness t (see FIG. 4) of the scale tape 200. In the exemplary embodiment, the protective sheet 220 is disposed such that the first end portion 220*a* of the protective sheet 220 is positioned at a distance L1 from an upstream end of a contact area L in the belt movement direction V where the contact area L is an area in which the brush roller 600 contacts the scale tape 200 in a state in which the protective sheet 220 is not disposed. Herein, a relationship between the distance L1 and the contact area L is L1=L/3. Such arrangement of the protective sheet 220 can prevent the end portion 210*a* of the reinforcing tape 210 from being peeled. Moreover, the arrangement of the protective sheet 220 can prevent paper powder and toner from being scattered from the brush roller 600 to an upstream side of the brush roller 600 in the belt movement direction V. In the exemplary embodiment, the protective sheet 220 as a protective member is disposed between the brush roller 600 as a cleaner and the scale tape 200. However, the cleaner can be the brush 650 described above with reference to FIG. 22. In such a case, the protective sheet 220 is disposed between the brush 650 and the scale tape 200, so that advantage substantially similar to the advantages obtained when the protective sheet 220 is disposed between the brush roller 600 and the scale tape 200 can be obtained.

In the transfer unit 500 as a belt device described above with reference to FIG. 21, the brush roller 600 as a single cleaner is rotatably disposed inside the cover 660 to scrape adherents such as paper powder and toner from the scale tape 200 with good efficiency to clean the scale tape 200. On the other hand, a belt device according to another exemplary embodiment includes a plurality of brush rollers as separate cleaners to further enhance efficiency.

Figure 30:
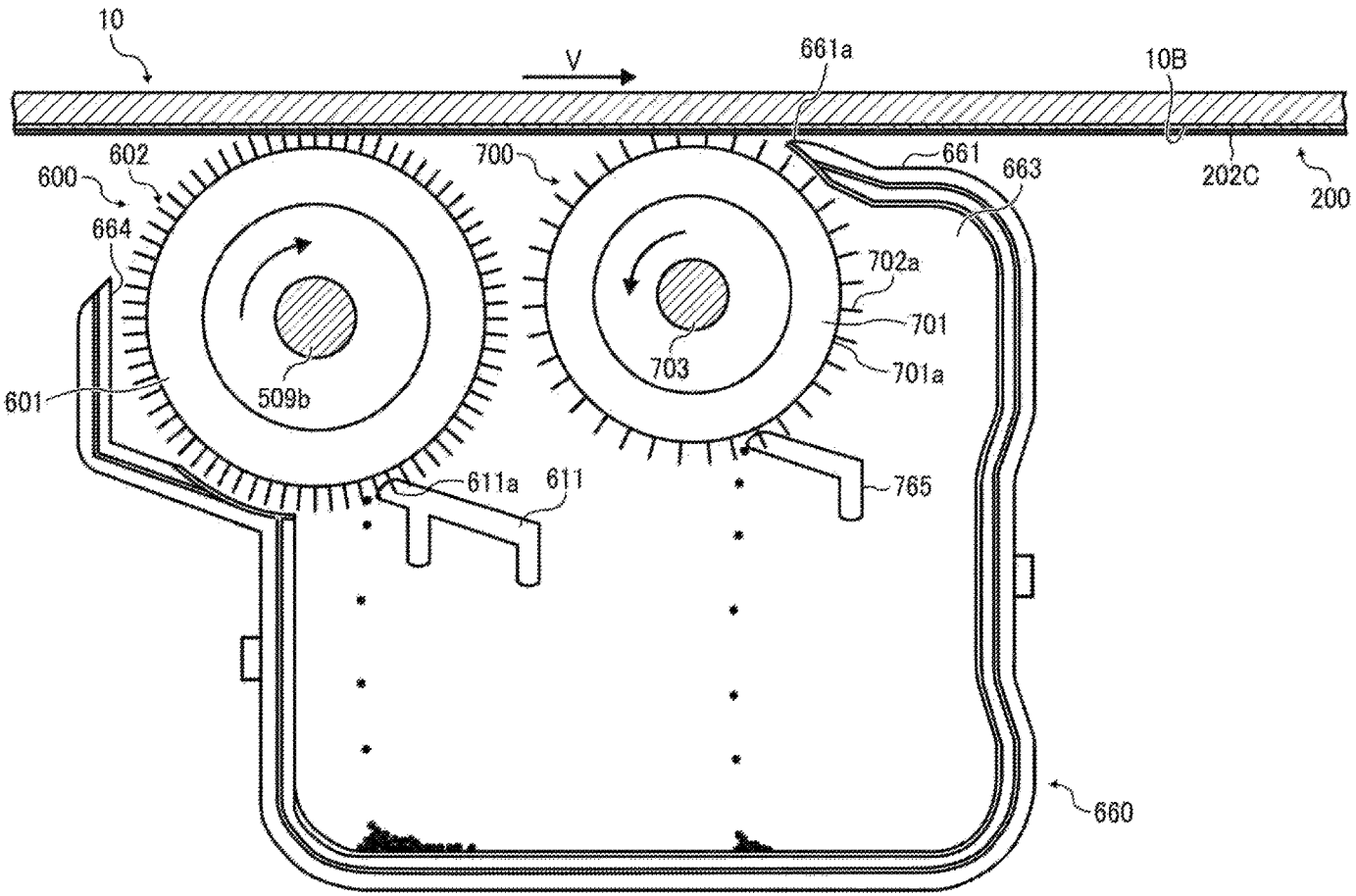
FIG. 30 is a sectional view illustrating a configuration of a cleaner in a belt device according to another exemplary embodiment.

As illustrated in FIG. 30, a brush roller 600 and a brush roller 700 as separate cleaners of rotators are arranged inside a cover 660. That is, in the exemplary embodiment, the brush roller 700 different from the brush roller 600 is added on a side opposite a scale tape 200 with respect to the configuration described above with reference to FIG. 21. In the exemplary embodiment as illustrated in FIG. 30, the brush rollers 600 and 700 are respectively arranged as an upstream side cleaner and a downstream side cleaner in a belt movement direction V of the scale tape 200. That is, in the exemplary embodiment, the brush roller 600 as a first cleaner is attached to a roller 509 as one of a plurality of supporting members, and the brush roller 700 as a second cleaner is disposed downstream of the first cleaner in the belt movement direction V. Accordingly, a width of the cover 660 illustrated in FIG. 30 is greater than a width of the cover 660 described above in FIG. 21 with respect to the movement direction V of the scale tape 200.

Similar to the brush roller 600, the brush roller 700 includes a cylindrical cored bar 701 and a brush portion 702 including a plurality of fibers 702*a*. The fibers 702*a* are disposed to radially project from a surface 701*a* as a circumferential surface of the cored bar 701 to contact the scale tape 200. The cored bar 701 extends in a belt width direction X. Downstream of the brush roller 600, the cored bar 701 of the brush roller 700 is rotatably fitted with a roller shaft 703 via a bearing. The roller shaft 703 is attached to a cover 660. The brush portion 702 is pressed against the scale tape 200 such that a tip of the fibers 702*a* reaches a recessed portion of an asperity portion 202C of the scale tape 200. The roller shaft 703 is positioned such that the tip of the fibers 702*a* is pressed against the scale tape 200 to reach the recessed portion. The fibers 702*a* of the brush portion 702 a made of a material such as synthetic resin fiber and conductive PET resin. In the exemplary embodiment, the fibers 702*a* made of conductive PET resin is implanted in the cored bar 701 to form the brush portion 702. The cover 660 is attached to a transfer unit 500 such that the scale tape 200 and the fibers 702*a* are reliably pressed against each other with good accuracy. Moreover, the brush roller 700 has a diameter smaller than a diameter of the brush roller 600.

Accordingly, the plurality of brush rollers 600 and 700 are arranged with respect to the belt movement direction V of the scale tape 200, so that most of adherents such as paper powder and toner adhering to the scale tape 200 is scraped and removed by the brush roller 600 on the upstream side. Even if there are some residual adherents remaining on the scale tape 200, the brush roller 700 on the downstream side can remove such adherents from the scale tape 200. Thus, such arrangement can prevent a reading failure of a scale sensor 60 as an optical detector even for an extended period of use. Moreover, in the configuration illustrated in FIG. 21, since a space Y is provided between the scale tape 200 and a cover end 661*a* positioned in an upper portion of the cover 660, a little amount of paper powder or toner may be scattered with the rotation of the brush roller 600 which cleans most of the adherents on the scale tape 200. There is concern that such scattering of the paper powder or toner may not only cause the inside of the belt device to become soiled over an extended period of use, but also re-adhesion of the paper powder or toner to the transfer belt 10 or the scale tape 200. As a result, a reading failure of the scale sensor 60 can occur. However, in the exemplary embodiment as illustrated in FIG. 30, the brush roller 700 is disposed on the downstream side of the brush roller 600. Such arrangement can block the space Y by the brush roller 700, thereby preventing scattering of paper powder or toner inside the belt device due to scattering of the paper powder or toner from the brush roller 600.

In the configuration illustrated in FIG. 30, since the brush roller 700 is rotatably supported and pressed against the transfer belt 10, the brush roller 700 is rotated clockwise. However, as far as rotation direction of the brush roller 700 is concerned, a counter-direction with respect to the belt movement direction V of the scale tape 200 (a reverse direction in an area where the brush roller 700 and the scale tape 200 are opposite each other) is effective from a standpoint of adherent scattering prevention. That is, the brush roller 600 is rotatable in the belt movement direction V, whereas the brush roller 700 is rotatable in a direction opposite the belt movement direction V. In FIG. 30, the brush roller 700 is preferably rotated counterclockwise (a counter-direction). The counterclockwise rotation (rotation in the counter-direction) of the brush roller 700 can markedly reduce an amount of the paper powder or toner to be scattered through the space Y between the cover end 661*a* and the scale tape 200 when the scale tape 200 and the fibers 702*a* are separated. In addition, the rotation of the brush roller 700 in the counterclockwise direction can provide an advantage that the paper powder and toner can be scraped with good efficiency. The paper powder and the toner collected by the brush roller 700 are scraped by a flicker 765 disposed inside the cover 660. The paper powder and the toner scraped by the flicker 765 are indicated by bullet points illustrated in FIG. 30. Since the flicker 765 is disposed inside the cover 660 and the periphery of the flicker 765 is covered with the cover 660, the paper powder and the toner are prevented from being scattered from the brush roller 700 to the inside of the belt device, and re-adhesion of the paper powder and the toner to the scale tape 200 and the transfer belt 10 can be prevented.

Figure 31:
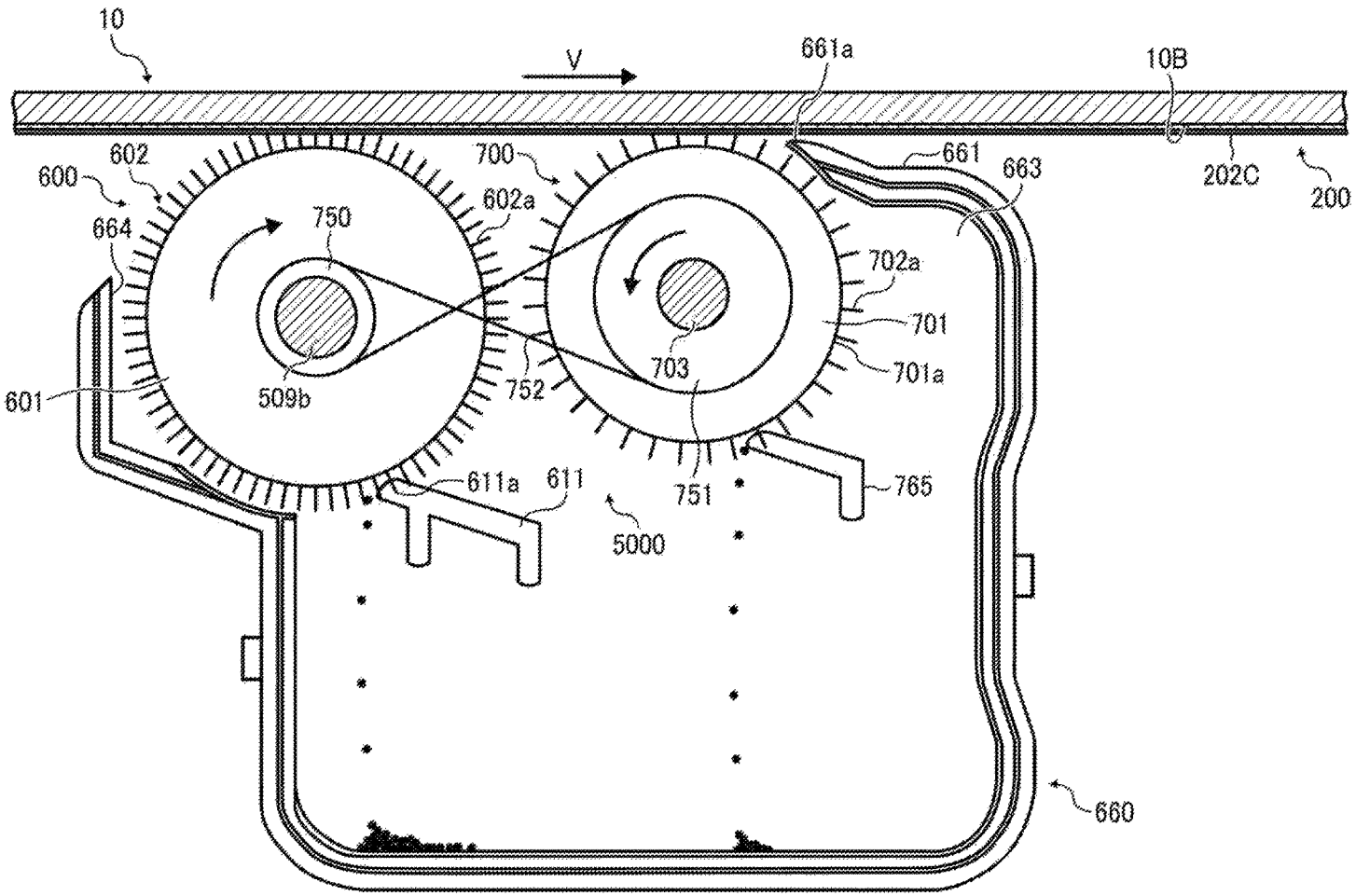
FIG. 31 is an enlarged view illustrating a configuration of a drive system for the cleaner illustrated in FIG. 30.
Figure 32:
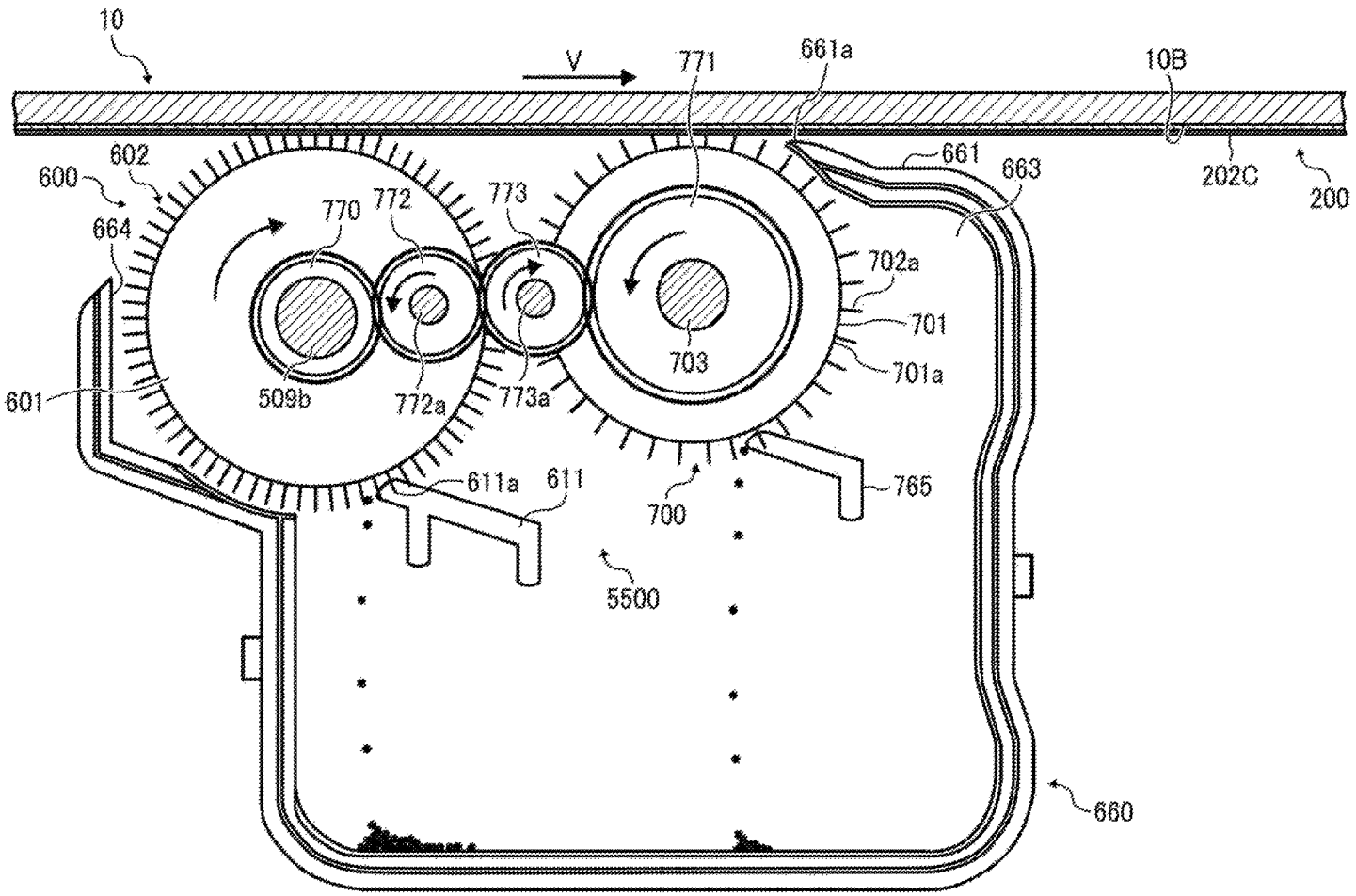
FIG. 32 is an enlarged view illustrating another configuration of the drive system for the cleaner illustrated in FIG. 30.
Figure 33:
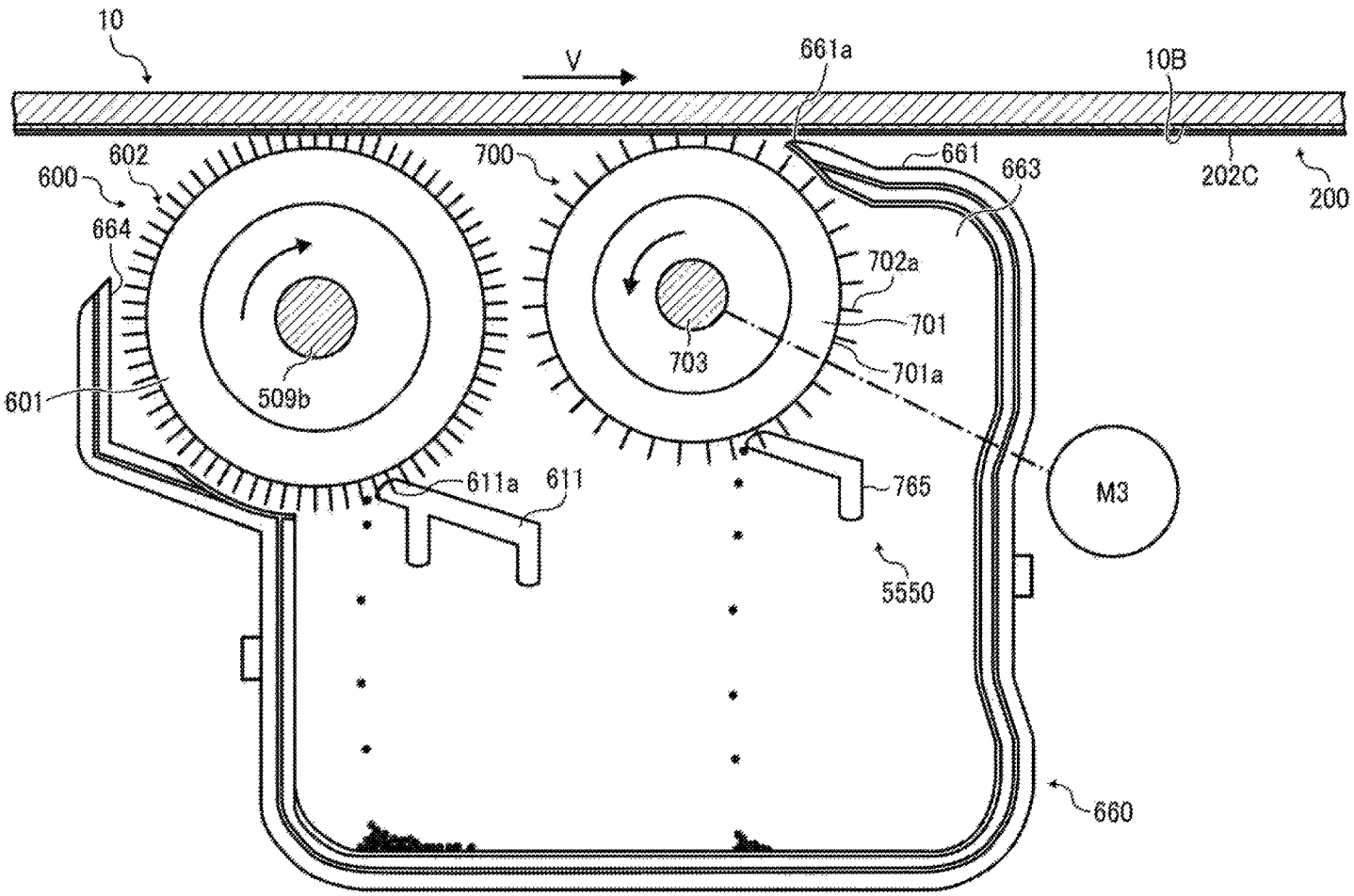
FIG. 33 is an enlarged view illustrating another configuration of the drive system for the cleaner illustrated in FIG. 30.

Next, a configuration of a drive system for the brush roller 700 is described with reference to FIGS. 31 through 33. A drive system 5000 illustrated in FIG. 31 includes a plurality of pulleys 750 and 751, and an endless belt 752 looped around the pulleys 750 and 751. The pulley 750 is disposed coaxially with the brush roller 600 and on the roller shaft 509*b* supporting the brush roller 600 which is rotated with the movement of the scale tape 200. The pulley 750 is rotated together with the rotation of the brush roller 600. The pulley 750 may be rotated with the rotation of the roller 509 as a belt supporting member coaxial with the brush roller 600. The pulley 751 is disposed coaxially with the brush roller 700 and on a roller shaft 703. The pulley 751 is rotated together with the brush roller 700. The belt 752 is looped around the pulleys 750 and 751 in a cross manner such that rotation directions of the brush rollers 600 and 700 are opposite. In the exemplary embodiment as illustrated in FIG. 30, the brush roller 600 is rotated clockwise with the movement of the scale tape 200 in the movement direction V, whereas the brush roller 700 is rotated counterclockwise by the drive system 5000.

That is, the belt device according to the exemplary embodiment includes the drive system 5000 for transmitting rotation of the brush roller 600 as a first cleaner to the brush roller 700 as a second cleaner via the endless belt 752 as a drive transmission unit and the pulleys 750 and 751. When the roller 509 as a supporting member rotates the brush roller 700, a driving torque necessary to rotate the brush roller 700 is sufficient. However, when the brush roller 600 rotates the brush roller 700, a driving torque is not sufficient due to friction resistance with the scale tape 200. Such insufficient driving torque may stop the rotation of the brush rollers 600 and 700.

To deal with such a case, it is conceivable that a demand driving torque that is needed for rotation of the brush roller 700 is reduced or a rotation driving torque that is transmitted to the brush roller 700 is increased. For example, a diameter of the pulley 750 is formed to be smaller than a diameter of the pulley 751. Such a configuration allows rotation of the brush roller 600 to be transmitted to a gear 771 via the belt 752. As a result, the brush roller 700 is rotated at lower speed than the brush roller 600. Hence, the rotation driving torque for rotation of the brush roller 700 is increased, so that the brush rollers 600 and 700 can be reliably rotated. That is, the brush rollers 600 and 700 are prevented from being not rotated or poorly rotated, thereby cleaning the scale tape 200 in a good manner. For a rotation ratio of the pulley 750 to the pulley 751, for example, a diameter of the pulley 751 is desirably at least 1.5 times or greater than a diameter of the pulley 750. The pulley ratio of 1.5 times or greater is determined based on consideration in which the poor rotation can be prevented if a power transmission efficiency of the transfer belt 10 is 96%, a friction of the brush roller 700 rotating with respect to the transfer belt 10 is 40% (a maximum for pieces of general resin) and a driving force of the brush roller 700 is increased to a value that is 50% or greater than a driving force of the brush roller 600.

Examples of methods for effectively reducing the demand driving torque needed for rotation of the brush roller 700 include reduction in a contact resistance between the brush roller 700 and the scale tape 200 by lowering an implantation density of the fibers 702*a* of the brush roller 700 to below an implantation density of the fiber 602*a* of the brush roller 600. The implantation density of the fiber 602*a* is desirably 1.5 times or greater than the implantation density of the fibers 702*a*. In addition to such a method, a diameter of the fibers 702*a* can be reduced smaller than a diameter of the fiber 602*a* to reduce a contact resistance between the brush roller 700 and the scale tape 200, thereby reducing the demand driving torque. Moreover, the fibers 702*a* can be made of a different material so as to be softer than the fiber 602*a*, so that a contact resistance between the brush roller 700 and the scale tape 200 can be reduced to reduce the demand driving torque. Similar to the pulley ratio, the implantation ratio of 1.5 times or greater is determined based on consideration in which the poor rotation can be prevented if a power transmission efficiency of the transfer belt 10 is 96%, a friction of the brush roller 700 rotating with respect to the transfer belt 10 is 40% (a maximum for pieces of general resin), and a fiber density of the brush roller 700 is increased to a value that is 50% or greater than a fiber density of the brush roller 600. That is, the number of fibers and a reaction force of the transfer belt 10 are thought to be proportional.

Examples of methods for effectively increasing the rotation driving torque transmitted to the brush roller 700 include reduction of an outer diameter of the cored bar 701 of the brush roller 700 to be smaller than an outer diameter of the cored bar 601 of the brush roller 600. The belt 752 as the drive transmission unit for transmitting the rotation of the brush roller 600 to the brush roller 700 is desirably an elastic body made of rubber. A strength of the belt 752 can be increased by mixing fiber with the rubber. Moreover, a core of the belt 752 can be made of a material with thread. The pulleys 750 and 751 can be made of a material such as simple metal and synthetic resin.

A drive system 5500 for the brush roller 700 is described with reference to FIG. 32, the drive system 5500 having a configuration different from a configuration of the drive system 5000 illustrated in FIG. 31. The drive system 5500 illustrated in FIG. 32 transmits rotation of the brush roller 600 to the brush roller 700 via a drive transmission unit. In FIG. 32, a plurality of gears for transmitting the rotation of the brush roller 600 to the brush roller 700 is used as the drive transmission unit. A gear 770 on the extreme upstream side among the plurality of gears is disposed on a roller shaft 509*b* and coaxial with the brush roller 600 (the roller 509) rotated by movement of the scale tape 200. The gear 770 is constructed so as to be rotated together with the brush roller 600. The gear 770 can be rotated with the rotation of a belt supporting member coaxial with the brush roller 600. The gear 771 among the plurality of gears is disposed on a roller shaft 703 and coaxial with the brush roller 700. The gear 771 is constructed so as to be rotated together with the brush roller 700. Gears 772 and 773 as a part of the plurality of gears mesh with each other between the gears 770 and 771. The gears 772 and 773 are supported by being rotatably fitted into respective shafts 772*a* and 773*a* supported by the cover 660.

When the roller 509 as a supporting member rotates the brush roller 700, a driving torque necessary to rotate the brush roller 700 is sufficient. However, when the brush roller 600 rotates the brush roller 700, a driving torque is not sufficient due to friction resistance with the scale tape 200 as described above in the drive system using the pulley illustrated in FIG. 31. Such insufficient driving torque causes poor rotation of the brush rollers 600 and 700. In some cases, the brush rollers 600 and 700 may stop rotating. To deal with such a case, a diameter of the gear 770 is reduced smaller than a diameter of the gear 771, and a rotation speed of the brush roller 700 is reduced to increase a rotation driving torque. In the drive system 5500 using a row of gears including such a plurality of gears 770 771, 772, and 773, the rotation of the brush roller 600 is transmitted in a deceleration manner from the gear 770 to the gear 771 via the gears 772 and 773. As a result, the brush roller 700 is rotated at a speed lower than a rotation speed of the brush roller 600. Accordingly, a rotation driving torque for rotation of the brush roller 700 is increased, and thus the brush rollers 600 and 700 can be reliably rotated. Moreover, the brush rollers 600 and 700 are prevented from being not rotated or poorly rotated, thereby cleaning the scale tape 200 in a good manner. Each of the gears 770 through 773 can be made of a material such as metal and synthetic resin.

Next, a drive system 5550 for the brush roller 700 is described with reference to FIG. 33. The drive system 5550 has a configuration different from a configuration of the drive system 5000 illustrated in FIG. 31 and a configuration of the drive system 5500 illustrated in FIG. 32. The above exemplary embodiment has been described using an example case in which the brush roller 700 is rotated with the rotation of the brush roller 600, or the brush roller 700 is rotated with the rotation of a belt supporting member coaxial with the brush roller 600. By contrast, in the drive system 5550 illustrated in FIG. 33, a roller shaft 703 is rotated using a drive motor M3 as a cleaner drive unit to rotate the brush roller 700 as a second cleaner. That is, the drive system 5550 includes the drive motor M3 as the clean drive unit for rotating the brush roller 700 as the second cleaner. In this case, the brush roller 700 is rotated counterclockwise (a counter direction) by the drive motor M3. Such counterclockwise rotation of the brush roller 700 can markedly reduce an amount of paper powder or toner to be scattered through the space Y between the cover end 661*a* and the scale tape 200 when the scale tape 200 and the fibers 702*a* are separated. Moreover, the brush roller 700 can be rotated with a necessary rotation driving torque without consideration of a friction resistance with the scale tape 200. Accordingly, the brush rollers 600 and 700 are prevented from being not rotated or poorly rotated, thereby cleaning the scale tape 200 in a good manner.

Figure 34:
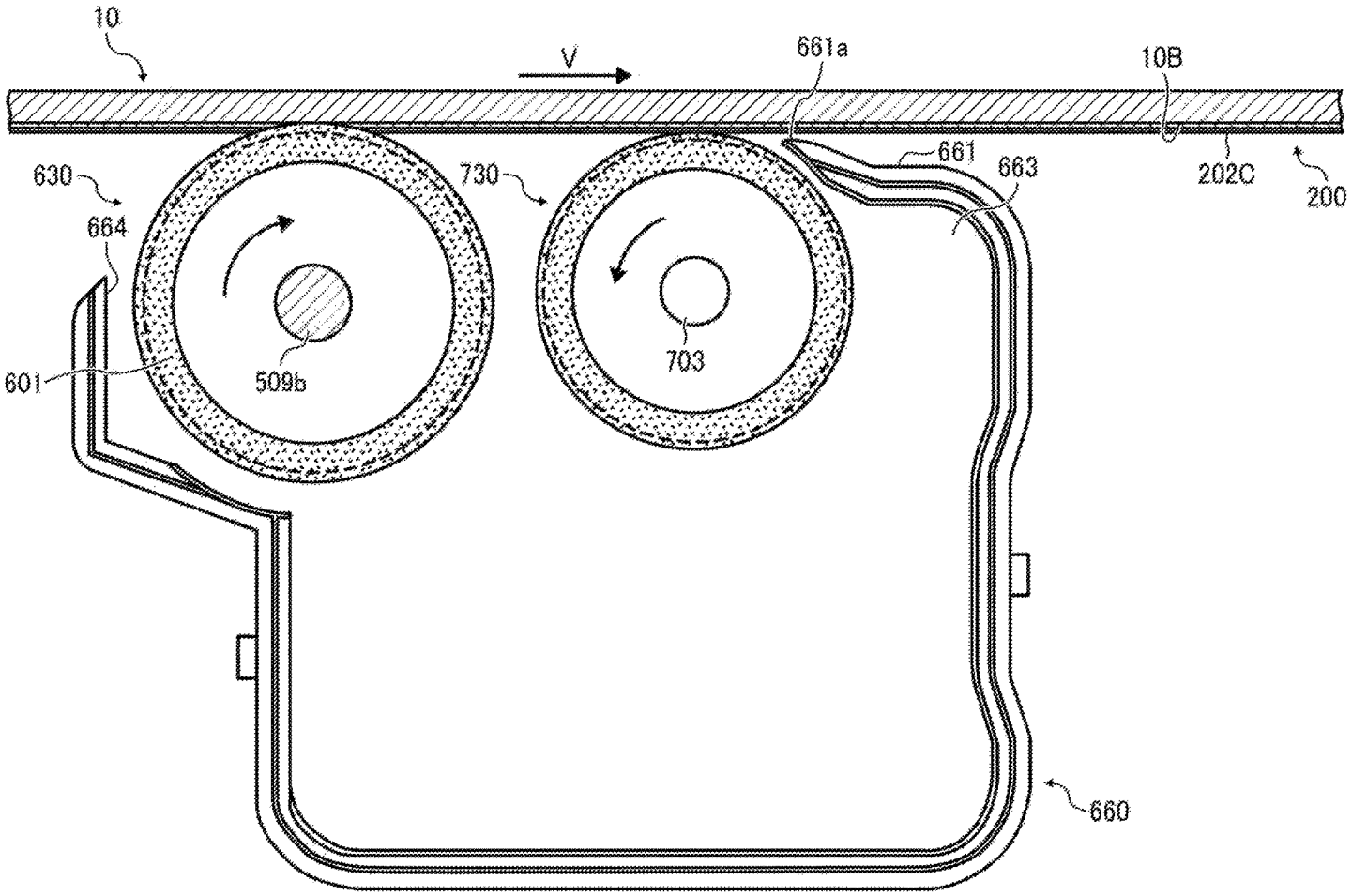
FIG. 34 is an enlarged view illustrating a modification example of a plurality of cleaners including sponge rollers.

In FIGS. 30 through 33, the downstream cleaner as the second cleaner is described as the brush roller 700 including the fibers 702*a*. However, as illustrated in FIG. 34, the downstream cleaner as the second cleaner can include a sponge roller 730 formed of foam. That is, a sponge roller 630 is used as an upstream cleaner, whereas the sponge roller 730 is used as a downstream cleaner. In this case, the sponge roller 730 is preferably made of sponge that has a larger number of bubbles than a sponge material of the sponge roller 630 to reduce a torque by a friction resistance with the scale tape 200. Alternatively, the sponge roller 730 can be made of a sponge material softer than a sponge material of the sponge roller 630.

The present disclosure has been described above with reference to specify exemplary embodiments but is not limited thereto. Various modifications and enhancements are possible without departing from scope of the disclosure. For example, in each of the exemplary embodiments, the electrophotographic color copier 1000 using toner is described as an example of an image forming apparatus. However, the belt device of the present disclosure can be applied to an image forming apparatus forming an image using ink. In such a case, the ink adhering to the scale tape 200 of the transfer belt 10 can be cleaned. Since absorption of ink is more preferred than scrape of ink when the ink is cleaned, the use of a cleaner made of form is more appropriate than the use of a brush-shaped cleaner. Moreover, the present disclosure has been described above with reference to preferable effects but is not limited thereto.

It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A belt device comprising:

a movable belt looped around a plurality of supporting members;

a detection target disposed extending along a direction of belt movement on at least one side of the belt in a width direction of the belt intersecting with the direction of belt movement;

an optical detector to detect the detection target; and a cleaner, attached to an end portion of at least one of the plurality of supporting members, to clean the detection target.

2. The belt device according to claim 1, wherein the cleaner includes a rotator to contact the detection target, and the rotator is a brush roller including a brush portion disposed to project from a circumferential surface of the rotator.

3. The belt device according to claim 2, further comprising a brush cleaner to contact the brush portion to clean the brush roller.

4. The belt device according to claim 3, further comprising a cover to cover the brush roller and the brush cleaner.

5. The belt device according to claim 1, wherein the cleaner includes a rotator to contact the detection target, and the rotator includes foam.

6. The belt device according to claim 5, further comprising a cleaning unit to contact a surface of the foam to clean the foam.

7. The belt device according to claim 6, further comprising a cover to cover the foam and the cleaning unit.

8. The belt device according to claim 4, wherein the cover includes an opening in a portion of the cover disposed opposite the belt, and wherein the rotator has a circumferential surface exposed from the opening.

9. The belt device according to claim 1, wherein the cleaner includes a rotator to contact the detection target, wherein the at least one of the plurality of supporting members is a roller disposed on a shaft, and wherein the rotator of the cleaner has an external diameter greater than an external diameter of the roller.

10. The belt device according to claim 1, wherein the cleaner includes a rotator to contact the detection target, and wherein the belt device further comprises a drive unit to rotate the rotator.

11. The belt device according to claim 1, wherein the cleaner includes a rotator to contact the detection target, and the belt is wound around the rotator at a winding angle of 10 degrees or greater.

12. The belt device according to claim 1, wherein the cleaner is a brush including a plurality of fibers and a plate base on which the plurality of fibers is arranged, and wherein one portion of the fibers contacts the detection target.

13. The belt device according to claim 1, wherein the at least one of the plurality of supporting members is a metal roller.

14. The belt device according to claim 1, wherein the detection target has a joint, and wherein the belt includes a sheet-shaped reinforcing member covering the joint.

15. The belt device according to claim 1, wherein the cleaner attached to the at least one of the plurality of supporting members is a first cleaner, and wherein the belt device further comprises a second cleaner disposed downstream of the first cleaner in the direction of belt movement.

16. An image forming apparatus comprising:

a belt device according to claim 1; and a transfer unit to transfer an image on the belt to a recording medium, wherein the cleaner is disposed downstream of the transfer unit in the direction of belt movement and an upstream side of the optical detector in the direction of belt movement.

17. The belt device according to claim 1, wherein the at least one of the plurality of supporting members is fixed to a roller shaft, and the roller shaft is fixed to the cleaner so that the at least one of the plurality of supporting members rotates with rotation of the cleaner.

18. The belt device according to claim 17, wherein a contact area between the cleaner and the belt in the width direction of the belt is narrower than a contact area between the at least one of the plurality of supporting members and the belt in the width direction of the belt.

19. A belt device comprising:

a movable belt looped around a plurality of supporting members;

a detection target disposed extending along a direction of belt movement on at least one side of the belt in a width direction of the belt intersecting with the direction of belt movement;

an optical detector to detect the detection target; and a cleaner, attached to at least one of the plurality of supporting members, to clean the detection target, wherein the detection target has a joint, wherein the belt includes a sheet-shaped reinforcing member covering the joint, and wherein a sheet-shaped protective member is disposed between the reinforcing member and the cleaner.

20. A belt device comprising:

a movable belt looped around a plurality of supporting members;

a detection target disposed extending along a direction of belt movement on at least one side of the belt in a width direction of the belt intersecting with the direction of belt movement;

an optical detector to detect the detection target; and a cleaner, attached to at least one of the plurality of supporting members, to clean the detection target, wherein the cleaner includes a rotator to contact the detection target, wherein the rotator is a brush roller including a brush portion disposed to project from a circumferential surface of the rotator, and wherein the belt device further comprises:

a sheet-shaped reinforcing member, disposed on the belt, to cover a joint of the detection target;

a cover to cover the brush roller, the cover including an opening allowing one portion of the brush roller to be exposed; and a sheet-shaped protective member, between the reinforcing member and the cleaner, disposed on the cover such that the protective member extends from an upstream side of the opening in the direction of belt movement to within the opening.

* * * * *